US006452590B1

(12) United States Patent
Awamoto et al.

(10) Patent No.: US 6,452,590 B1
(45) **Date of Patent: *Sep. 17, 2002**

(54) METHOD AND DEVICE FOR DRIVING A DISPLAY PANEL

(75) Inventors: Kenji Awamoto; Koichi Sakita; Kazuo Yoshikawa, all of Kawasaki (JP)

(73) Assignee: Fujitsu Limited, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/438,783

(22) Filed: Nov. 12, 1999

(30) Foreign Application Priority Data

Jan. 14, 1999 (JP) ..... 11-007125

(51) Int. Cl.[7] ..... G09G 5/00
(52) U.S. Cl. ..... 345/211; 345/205
(58) Field of Search ..... 345/204, 211, 345/214, 215; 315/169.1–169.4

(56) References Cited

U.S. PATENT DOCUMENTS 5,654,728 A * 8/1997 Kanazawa et al. ..... 345/68
5,943,030 A * 8/1999 Minamibayashi ..... 345/60
6,249,279 B1 * 6/2001 Shirasawa ..... 345/211

FOREIGN PATENT DOCUMENTS

| | | | |
|---|---|---|---|
| EP | 0 261 584 | 3/1988 | |
| EP | 0 696 024 | 2/1996 | |
| JP | 10105114 A * | 4/1998 | ..... G09G/3/28 |
| JP | 10268831 A * | 10/1998 | ..... G09G/3/28 |

* cited by examiner

*Primary Examiner*—Xiao Wu
*Assistant Examiner*—Alexander Eisen
(74) *Attorney, Agent, or Firm*—Staas & Halsey LLP

(57) ABSTRACT

A method and device for driving a display panel are provided in which power consumption due to interelectrode capacitance in the addressing period is reduced with less number of components in a driving circuit. Four switches 41–44 are provided for each of plural data electrodes. The four switches 41–44 control open and close of a current path p1 from a bias potential line 81 to the data electrode A, a current path p2 from a capacitor 55 to the data electrode A, a current path p3 from the data electrode A to the capacitor 55, and a current path p4 from the data electrode A to the ground potential line 82.

8 Claims, 19 Drawing Sheets

METHOD AND DEVICE FOR DRIVING A DISPLAY PANEL

BACKGROUND OF THE INVENTION

1. Field of the Invention

The present invention relates to a method and a device for driving a display panel such as a plasma display panel (PDP), a plasma addressed liquid crystal (PALC), a liquid crystal display (LCD) or a field emission display (FED).

The display panel is widely used as a device that can substitute for a CRT in various fields. For example, a PDP is available in the market as a flat type television set having a wide screen above 40 inches. One of the challenges for making the wide screen with high definition is to control capacitance between electrodes.

2. Description of the prior art

The display panel has an electrode matrix including scan electrodes for row selection and data electrodes for column selection. On each cross point of the scan electrodes and the data electrodes, a single display portion having a display element is disposed. The display element of a PDP and a PALC is a discharging cell. An LCD has a liquid crystal cell as the display element and the FED has a field emitter as the display element. A surface discharge type PDP that is available in the market has two electrodes for each row. However, only one of the two electrodes is used for row selection. Therefore, the electrode arrangement of the surface discharge type PDP is regarded as a single matrix similar to the others from the viewpoint of selecting the display element.

Contents of the display is decided by the selective addressing (i.e., addressing of row). An addressing period of one frame is divided into row selection periods of the number same as the number of rows of the screen. Each scan electrode is biased to a predetermined potential in one of the row selection periods so as to be active. In synchronization with this row selection, display data for the row is output from all data electrodes. In other words, potentials of data electrodes are controlled simultaneously in accordance with the display data. The most typical method for controlling the potentials of the data electrodes is to dispose a switching device between each output terminal of plural power sources having different potentials and the data electrode, and to control the switching device by a pulse signal synchronizing with the row selection so as to connect or disconnect the output terminal of the power source and the data electrode.

A driving method in which the addressing and sustaining required for an AC type PDP are separated on the time axis is widely used for the AC type PDP. The addressing is performed for forming charge distribution corresponding to the display data, and then discharge in gas is generated utilizing wall electric charge by the number of times corresponding to intensity. In the sustaining period, a voltage pulse is applied to a pair of two electrodes alternately, so that the relative potential between the electrodes changes periodically. Along with this change of the relative potential, a capacitance between the electrodes (hereinafter, referred to as an interelectrode capacitance) is charged and discharged repeatedly. The charging and discharging of the interelectrode capacitance are waste of electric power that cannot contribute to light emission. In order to reduce the power loss, the PDP has a power recycling circuit including a capacitor and an inductor having predetermined capacitance and inductance. The charge of the interelectrode capacitance is discharged into the capacitor for recycling, and the charge of the capacitor is retrieved to charge the interelectrode capacitance for reusing repeatedly. The inductor is disposed between the capacitor and the interelectrode capacitance so as to form a resonance circuit that speeds up the movement of the charge and enlarges an amplitude and a reuse ratio of the charge (i.e., a power recycling ratio).

In the above-mentioned sustaining period, a constant pattern of voltage pulse is applied to the plural electrodes wothout depending on the display data. Therefore, only one power recycling circuit is necessary for the electrodes. However, in the case of addressing, the potential of each data electrode depends on the display data, and the relative potential between the neighboring data electrodes is not constant. Therefore, in order to reduce the power consumption due to the interelectrode capacitance in the addressing, each data electrode requires one power recycling circuit. Since the capacitor and the inductor having a sufficient capacitance or inductance are difficult to be packed into an IC chip, the driving device becomes large size, and the number of man-hours required for manufacturing becomes a large. In addition, in order to avoid floating of a logic circuit for generating switching signals, isolation is needed between the logic circuit and the power recycling circuit, resulting in a complicated and expensive circuit configuration. For this reason, the conventional display panel available in the market does not recycle the power for addressing.

High definition and wide screen are being promoted for display panels, so that the number of data electrode and driving frequency is increasing. Therefore, power consumption of the. interelectrode capacitance is being a big problem. Especially, for PDPs, the power consumption in the addressing period is coming close to that in the sustaining period, so the power recycling will be necessary for the addressing too. If trying to reduce the power consumption without the power recycling, the number of displayed colors or the intensity should be restricted, which affects the display quality.

SUMMARY OF THE INVENTION

The object of the present invention is to reduce the power consumption due to the interelectrode capacitance in the addressing period, and decrease the number of components in the driving circuit.

In the present invention, for each of plural data electrodes, a discharging path to a power recycling circuit and a charging path from the power recycling circuit are disposed, and these paths are used separately in accordance with display data. In addition, if the q-th data and the (q+1)th data are the same in the display data given to each data electrode sequentially in synchronization with row selection of addressing, both the discharging path and the charging path are opened so as to keep the electrode potential.

Basically, providing four switches to each data electrode enables controlling connection between the data electrode and the power supply line or the ground line, and controlling connection with the power recycling circuit, so that plural data electrodes can share one power recycling circuit.

Furthermore, each data electrode can have two switches for controlling connection with the power recycling circuit, so that data electrode can share the switch for controlling connection with the power supply line or the ground line. In this configuration, electric power can be recycled without depending on the combination of display data by providing diodes adequately so that currents between data electrodes can be prevented. However, it is not always necessary to prevent the current between data electrodes. Namely, if the number of objects to be charged and the number of objects to be discharged are not the same in plural data electrodes that share one power recycling circuit, a potential difference is generated between the common connection node of the plural data electrodes and the recycling capacitor, so that charging current or discharging current will appear. Therefore, recycling efficiency is not zero. Only when the number of objects to be charged and the number of objects to be discharged are the same coincidentally, the potential of the common connection node becomes substantially the middle potential between the power source potential and the ground potential due to the current between data electrodes, and neither the charging current or the discharging current appears.

The switches for the data electrodes are packed into an IC chip. Thus, the driving circuit of the display panel having plural data electrodes can be realized in a small size. The switches that plural data electrodes share also can be packed into the IC chip. However, if the packing is difficult because of restriction of current capacity, they can be made up of discrete components.

In the first aspect of the present invention, the method for driving a display panel by controlling potential for addressing of electrodes arranged within a screen, includes steps of providing a first to a fourth switches for each of plural data electrodes controlled by display data, using the first switch for making or breaking a current path from a bias potential line to a data electrode corresponding to the first switch, using the second switch for making or breaking a first resonance current path from a power recycling capacitor to a data electrode corresponding to the second switch, using the third switch for making or breaking a second resonance current path from a data electrode corresponding to the third switch to the capacitor, and using the fourth switch for making or breaking a current path from a data electrode corresponding to the fourth switch to a ground potential line.

In the second aspect of the present invention, the driving method further includes the steps of connecting all of the first switches to the bias potential line via a bias controlling switch, connecting all of the fourth switches to the ground potential line via a ground controlling switch, and keeping both the bias controlling switch and the ground controlling switch- in the open state until a predetermined period passes after the time point when at least one of the second switches or at least one of the third switches changes from the open state to the close state.

In the third aspect of the present invention, the bias controlling switch and the ground controlling switch are controlled at the same timing.

In the fourth aspect of the present invention, the driving method further includes the steps of connecting all of the second switches to the capacitor via a first auxiliary switch, connecting all of the third switches to the capacitor via a second auxiliary switch, controlling the first auxiliary switch so as to start supplying current from the capacitor to the plural data electrodes simultaneously, and controlling the second auxiliary switch so as to start supplying current to the capacitor from the plural data electrodes simultaneously.

In the fifth aspect of the present invention, the first auxiliary switch and the second auxiliary switch are controlled at the same timing.

In the sixth aspect of the present invention, the device for driving a display panel by controlling potential for addressing of electrodes arranged within a screen includes a first to a fourth switches for each of plural data electrodes controlled by display data. The first switch is used for making or breaking a current path from a bias potential line to a data electrode corresponding to the first switch. The second switch being used for making or breaking a first resonance current path from a power recycling capacitor to a data electrode corresponding to the second switch. The third switch being used for making or breaking a second resonance current path from a data electrode corresponding to the third switch to the capacitor. The fourth switch being used for making or breaking a current path from a data electrode corresponding to the fourth switch to a ground potential line.

In the seventh aspect of the present invention for the driving device, the first resonance current path includes a first inductance element for resonance with the capacitance within the screen, and the second resonance current path includes a second inductance element for resonance with the capacitance.

In the eighth aspect of the present invention, the method for driving a display panel by controlling potential for addressing of electrodes arranged within a screen, includes the steps of providing first and second switches for each of plural data electrodes controlled by display data, connecting all of the first switches to the bias potential line via a bias controlling switch, connecting all of the second switches to the ground potential line via a ground controlling switch, using the bias controlling switch for making or breaking a current path from a bias potential line to the plural data electrodes, using the first switch for making or breaking a first resonance current path from a power recycling capacitor to a data electrode corresponding to the first switch, using the second switch for making or breaking a second resonance current path from a data electrode corresponding to the first switch to the capacitor, and using the ground controlling switch for making or breaking a current path from the plural data electrodes to the ground potential line.

In the ninth aspect of the present invention, the driving method further includes the steps of providing diodes for all of the first switches so as to prevent a current from each of the first switches to the other and providing diodes for all of the second switches so as to prevent a current from each of the second switches to the other.

In the tenth aspect of the present invention for the driving method, the bias controlling switch and the ground controlling switch are controlled at the same timing.

In the eleventh aspect of the present invention, the driving method further includes the steps of connecting all of the first switches to the capacitor via a first auxiliary switch, connecting all of the second switches to the capacitor via a second auxiliary switch, controlling the first auxiliary switch so as to start supplying current from the capacitor to the plural data electrodes simultaneously, and controlling the second auxiliary switch so as to start supplying current to the capacitor from the plural data electrodes simultaneously.

In the twelfth aspect of the present invention for the driving method, the first auxiliary switch and the second auxiliary switch are controlled at the same timing.

In the thirteenth aspect of the present invention, the device for driving a display panel by controlling potential for addressing of electrodes arranged within a screen includes first and second switches for each of plural data electrodes controlled by display data. All of the first switches are connected to the bias potential line via a bias controlling switch. All of the second switches are connected to the ground potential line via a ground controlling switch. The bias controlling switch is used for making or breaking a current path from a bias potential line to the plural data electrodes. The first switch is used for making or breaking a first resonance current path from a power recycling capacitor to a data electrode corresponding to the first switch. The second switch is used for making or breaking a second resonance current path from a data electrode corresponding to the first switch to the capacitor. The ground controlling switch is used for making or breaking a current path from the plural data electrodes to the ground potential line.

In the fourteenth aspect of the present invention, the driving device further includes diodes for preventing a current from each of the first switches to the other and diodes for preventing a current from each of the second switches to the other.

In the fifteenth aspect of the present invention for the driving device, the first resonance current path includes a first inductance element for resonance with a capacitance within the screen, and the second resonance current path includes a second inductance element for resonance with the capacitance.

In the sixteenth aspect of the present invention, the integrated circuit device for controlling potentials of m ($m \geqq 2$) data electrodes arranged within a screen of a display panel, includes m output terminals each of which corresponds to each of the m data electrodes, four connecting terminals for connecting to an external power recycling circuit, 4×m switches for controlling continuity between each of the m output terminals and each of the four connecting terminals and a switch driver circuit for controlling the 4×m switches.

In the seventeenth aspect of the present invention for the integrated circuit device, the switch driver circuit includes a register that can memorize 4×m bits of control data, and gives four bits of the control data corresponding to each of the m output terminals to four switches corresponding to the one output terminal one bit by one bit.

In the eighteenth aspect of the present invention for the integrated circuit device, the switch driver circuit includes a signal gate for forcing the two of four switches corresponding to each of them output terminals to be the open state responding to an external control signal.

In the nineteenth aspect of the present invention for the integrated circuit device, the switch driver circuit includes a register that can memorize 2×m bits of control data, and generates four bits of data in accordance with two bits corresponding to each of the m output terminals so as to give the data to four switches corresponding to the one output terminal one bit by one bit.

In the twentieth aspect of the present invention for the integrated circuit device, the switch driver circuit includes a register that can memorize m bits of control data, gives one bit of the control data corresponding to each of the m output terminals to two of four switches corresponding to the one output terminal, and gives the inverted bit of the one bit to the other two of four switches.

In the twenty-first aspect of the present invention, the integrated circuit device for controlling potentials of m ($m \geqq 2$) data electrodes arranged within a screen of a display panel, includes m output terminals each of which corresponds to each of the m data electrodes, two connecting terminals for connecting to an external power recycling circuit, 2×m switches for controlling continuity between each of them output terminals and each of the two connecting terminals and a switch driver circuit for controlling the 2×m switches.

In the twenty-second aspect of the present invention for the integrated circuit device, the switch driver circuit includes a register that can memorize 2×m bits of control data, and gives two bits of the control data corresponding to each of the m output terminals to two switches corresponding to the one output terminal one bit by one bit.

In the twenty-third aspect of the present invention for the integrated circuit device, the switch driver circuit includes a register that can memorize m bits of control data, gives one bit of the control data corresponding to each of the m output terminals to one of two switches corresponding to the one output terminal, and gives the inverted bit of the one bit to the other one of two switches.

In the twenty-fourth aspect of the present invention, the display device includes a display panel including M ($2 \leqq M \leqq m \times k$, m is an integer greater than one and k is an integer greater than zero) data electrodes and N ($2 \leqq N$) scan electrodes arranged within a screen, and a driving device for controlling potentials of the data electrodes and the scan electrodes for selective addressing. The driving device including an address driver circuit made up by k integral circuit devices and i ($1 \leqq i \leqq k$) power recycling circuits. The power recycling circuit includes first and second inductance elements for resonance with the capacitance within the screen.

DESCRIPTION OF THE PREFERRED EMBODIMENTS

Hereinafter, the present invention will be explained more in detail with reference to embodiments and drawings.

Figure 1:
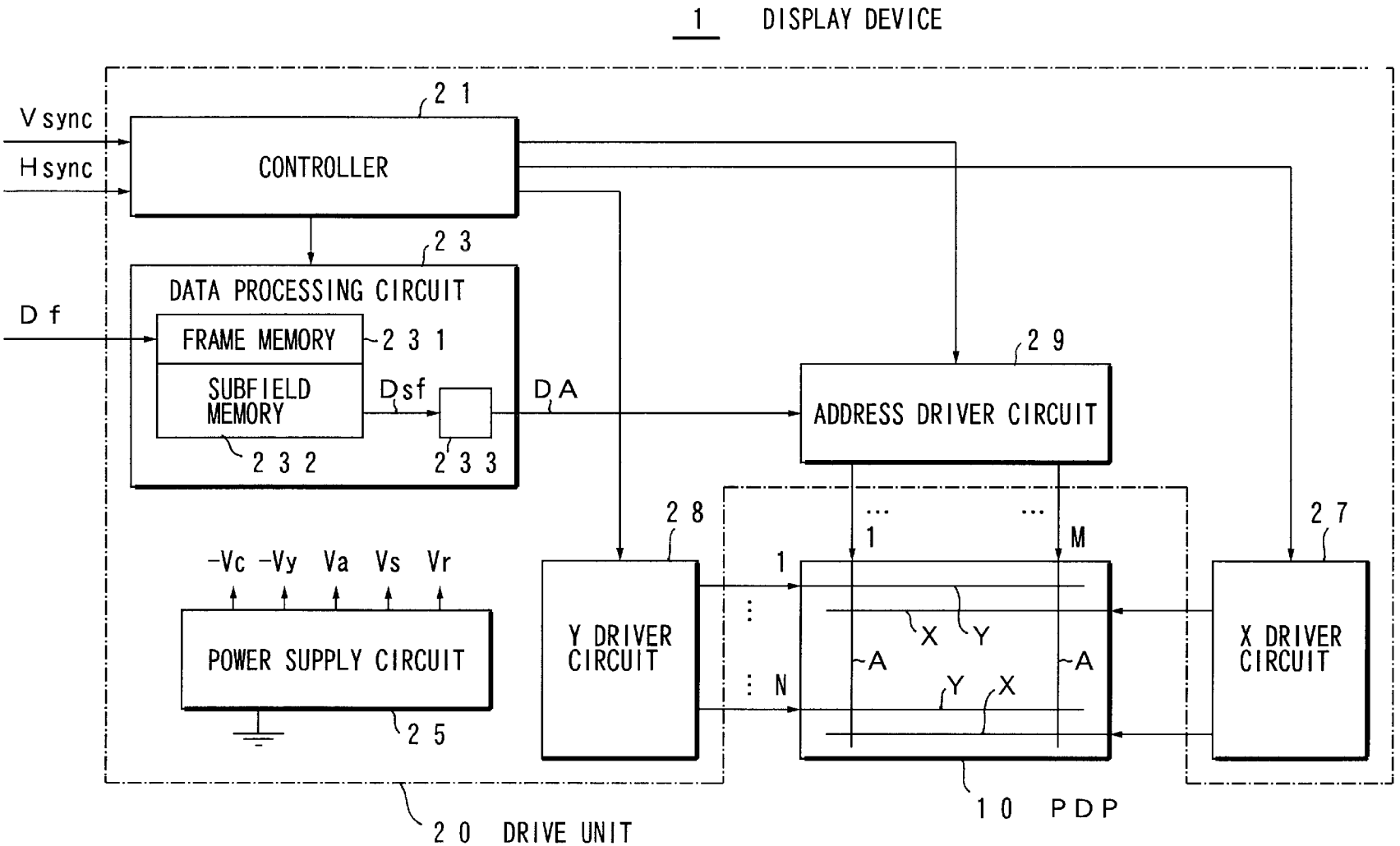
FIG. 1 is a schematic diagram showing a display device in accordance with the present invention.

FIG. 1 is a diagram showing a display device 1 in accordance with the present invention.

The display device 1 includes an AC type plasma display panel (PDP) 10 that is a thin type color display device, and a drive unit 20 for selectively lightening cells arranged in M rows and N columns to make up a screen. The display device 1 is used as a flat type television set, a monitor of a computer system or other equipment.

The PDP 10 includes a first and a second main electrodes X, Y disposed in parallel making a pair for generating sustaining discharge (or display discharge). In each cell, the main electrodes X, Y and an address electrode A as a third electrode cross each other to form three electrodes surface discharge structure. The main electrodes X, Y extend in the row direction (the horizontal direction) within the screen. The main electrode Y is used as a scan electrode for selecting cells in a row for addressing. The address electrode A extends in the column direction (the vertical direction), and is used as a data electrode for cells in a column. The range of the substrate within which the main electrodes and the address electrodes cross with each other is. a display range (i.e., a screen).

The drive unit 20 includes a controller 21, a data processing circuit 23, a power supply circuit 25, an X driver circuit 27, a Y driver circuit 28, and an address driver circuit 29 according to the present invention. The drive unit 20 is disposed at the rear side of the PDP 10, and each driver and the electrode of the PDP 10 are connected to each other electrically by a flexible cable (not shown). Field data Df representing an intensity level (a gradation level) of each color R, G, B for each pixel are supplied to the drive unit 20 from an external equipment such as a TV tuner or a computer, along with various synchronizing signals.

The field data Df are stored in a frame memory 231 of a data processing circuit 23, and are converted into subfield data Dsf for performing gradation display by dividing the field into a predetermined number of subfields. The subfield data Dsf are stored in a frame memory 232, and are transferred in series to a timing circuit 233 in synchronization with the progress of the display. Each bit of the subfield data Dsf represents ON or OFF of the cell in the subfield, more precisely ON or OFF of the address discharging. The timing circuit 233 converts the input subfield data Dsf into predetermined bits of control data DA in series so as to transfer the same to the address driver circuit 29. The control data DA is used for controlling switching in the address driver circuit 29. The number of bits of the control data DA corresponds to the configuration of the address driver circuit 29.

The X driver circuit 27 controls the potential of the main electrode X, while the Y driver circuit 28 controls the potential of the main electrode Y. The X driver circuit 27 and the Y driver circuit 28 have a power recycling circuit for collecting and reusing the power that was used for charging a capacitor between the main electrodes in the sustaining period. The address driver circuit 29 controls the potentials of the M address electrodes (data electrodes) A in accordance with the control data DA. These driver circuit are provided with a predetermined electric power by a power supply circuit 25 via wiring conductors (not shown).

Figure 2:
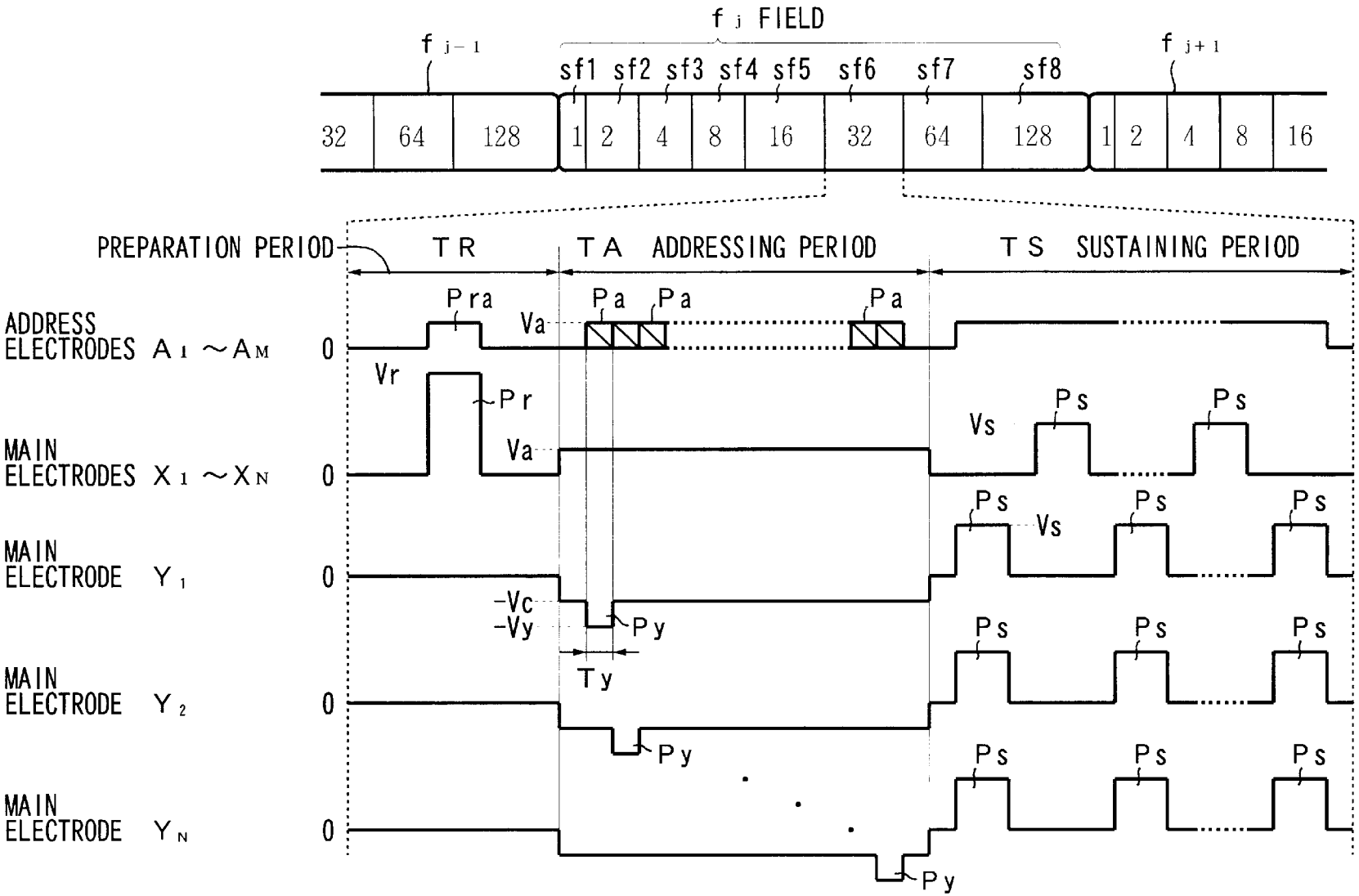
FIG. 2 shows a general driving sequence.

FIG. 2 shows a general driving sequence.

In the display of a television image, gradation is reproduced by binary control of lightening. Therefore, each sequential field f that is an input image is divided into, e.g., eight subframes sf1, sf2, sf3, sf4, sf5, sf6, sf7 and sf8 (the suffix represents the order of display). In other words, each field f included in the frame is replaced by a set of eight subframes sf1–sf8. When reproducing a noninterlace image such as an output of a computer, each frame is divided into eight. Weighting is performed so that relative intensities of the subfields sf1-sf are substantially 1:2:4:8:16:32:64:128 for setting the number of sustaining discharge times of each subfield sf1–sf8. Combination of ON and OFF for each subfield enables 256 steps of intensity for each color R, G, B, so that $256^3$ colors can be displayed.

The subfield period assigned to each subfield sf1–sf8 includes a preparation period TR for initializing charge distribution, an addressing period TA for forming charge distribution in accordance with display contents, and a sustaining period TS for sustaining the lightened state to ensure the intensity in accordance with the gradation level.

The lengths of the preparation period TR and the addressing period TA are constant without depending on the weight of the intensity, while the length of the sustaining period TS is longer for larger weight of the intensity. Namely, the lengths of eight subfield periods of one field f are different from each other.

The driving waveform can be changed in its amplitude, polarity and timing, and the driving waveform shown in FIG. 2 is merely an example. Here, the illustrated waveform will be explained supposing that the write format addressing is performed. In FIG. 2, reference numerals of the electrodes are accompanied with suffix representing the order of arrangement.

In the preparation period TR, a pulse Pr having a peak value Vr is applied to all of the main electrodes $X_1$–$X_N$ simultaneously. In the same time, a pulse Pra is applied to all of the address electrodes $A_1$–$A_M$ for preventing discharge between the address electrodes $A_1$–$A_M$ and the main electrodes $X_1$–$X_N$. The application of the pulse Pr generates surface discharge over the entire screen between the main electrodes. Thus, self-discharging due to excessive wall electric charge is generated at the rising edge of the pulse Pr, so that the wall electric charge disappears almost completely.

In the addressing period TA, the wall electric charge necessary for sustaining is formed only in the cell to be lightened. All of the main electrodes $X_1$–$X_N$ nd all of the main electrodes $Y_1$–$Y_N$ are biased to a predetermined potential Va, –Vc, and a scan pulse Py is applied to one main electrode Y corresponding to the selected row every row selection period (a scan period for one row) Ty. Namely, the main electrode Y is biased to the potential –Vy. At the same time, an address pulse Pa is applied to only the address electrode A corresponding to the cell to be lightened. Namely, the potentials of the address electrodes $A_1$–$A_M$ are controlled to zero or Va in accordance with the control data DA corresponding to the subfield data Dsf of M columns of the selected row. In the cell to be lightened, discharging occurs between the main electrode Y and the address electrode A, which becomes a trigger for generating the surface discharge between the main electrodes. These sequential discharges make the address discharge. The address discharge forms a desired wall electric charge. In the case of erasing address format, the entire surface is charged in the preparation period TR and the address discharge is generated only in the cell not to be lightened so that undesired wall electric charge is erased. Thus, the wall electric charge remains in the cell to be lightened.

In the sustaining period TS, all of the address electrode $A_1$–$A_M$ is biased to the potential Va so as to prevent undesired discharge. Then, a sustaining pulse Ps is allied to the main electrode $Y_1$–$Y_N$ nd the main electrode $X_1$–$X_N$ alternately. Since the peak value Vs of the sustaining pulse Ps is lower than the firing potential, discharge will not occur without superimposition of the wall voltage. Therefore, the surface discharge occurs only in the cell to be lightened in which the wall electric charge was formed in the addressing period TA every application of the sustaining pulse Ps. On this occasion, discharging gas emits ultraviolet rays, which pumps fluorescent substances to light.

Hereinafter, power recycling in accordance with the present invention will be explained.

Figure 3A:
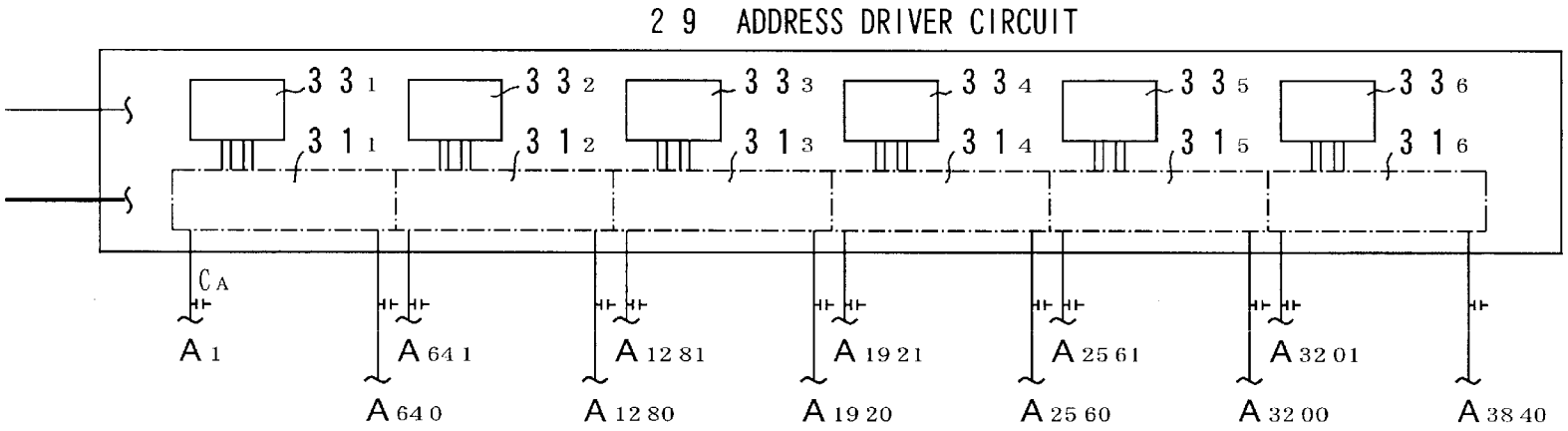
FIGS. 3A and 3B are schematics of the address driver circuit.
Figure 3B:
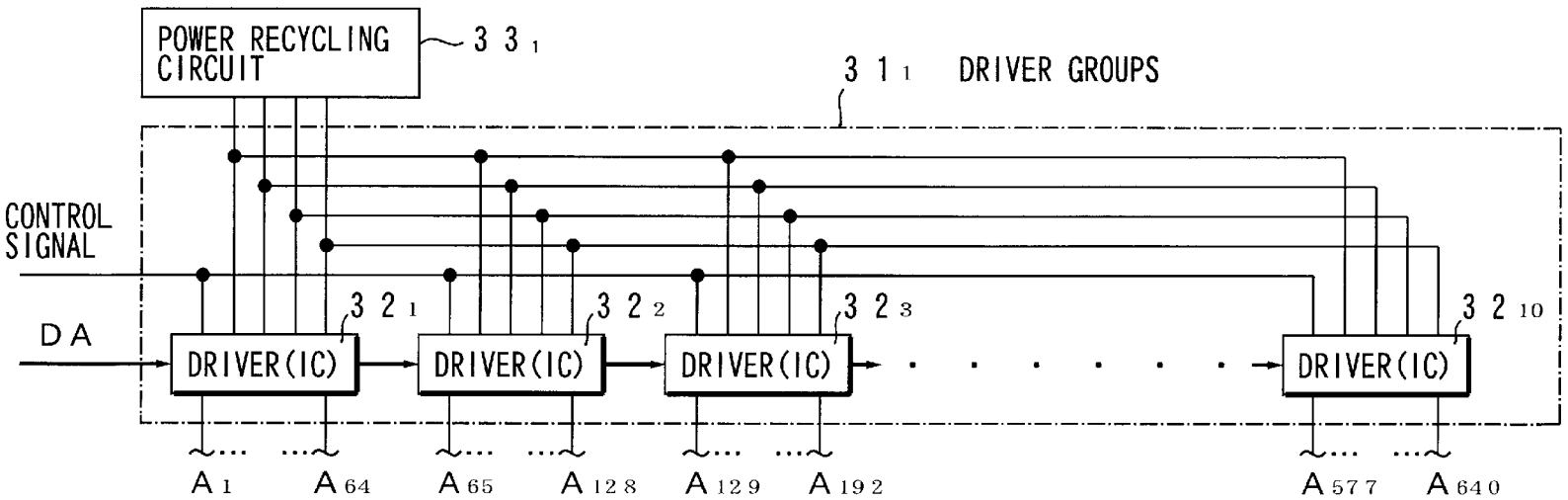

FIGS. 3A and 3B are schematics of the address driver circuit 29. FIG. 3A shows an overall configuration, and FIG. 3B shows a configuration of a portion corresponding to one power recycling circuit. In FIGS. 3A and 3B, elements having the same function are accompanied with the same numeral with different suffix representing the order of arrangement. However, in the following explanation, the suffix may be omitted in the case where it is not necessary to distinguish the order of arrangement.

The screen of the PDP 1 is SXGA (having 1024×280 pixels). One pixel includes three subpixels arranged horizontally for reproducing color. One address electrode A is assigned to each subpixel, so the sum of the address electrode A is 3840 (=1280×3). In this example, the potentials of the 3840 address electrodes $A_1$–$A_{3840}$ are controlled by sixty drivers 32. Each driver 32 is an integral circuit device being in responsible for controlling the sixty-four address electrodes A as shown in FIG. 3B. The sixty drivers 32 are divided into six driver groups 311–316, each of which includes ten drivers. The power recycling circuits 331–336 are disposed one to each of the driver groups 311–316, i.e., one to 640 address electrodes A. The address driver circuit 29 includes sixty drivers 32 and six power recycling circuits 33. The power recycling circuit 33 is disposed for reducing power consumption by interelectrode capacitance $C_A$ accompanying each of the address electrodes $A_1$–$A_{3840}$. The interelectrode capacitance $C_A$ is a capacitor between neighboring address electrodes, as well as the address electrode A and the main electrodes X, Y. The number m of the address electrodes A for which each driver 32 is responsible, and the number i of the power recycling circuits 33 can be selected within the range satisfying the following relationship.

$1 \leqq m \leqq M$ (M is the sum of the address electrodes)

$1 \leqq i \leqq k$ (k is the number of drivers 32)

The number k is M/m if the value is integer, while it is rounded up if the value is not integer.

The sixty drivers 32 have the same configuration, so the configurations of the driving circuit (five types) are explained focusing the first driver 32 as follows. In order to distinguish the examples, the reference numerals of the above-mentioned elements are accompanied with suffixes a (for the first example), b (for the second example), c (for the third example), d (for the fourth example) and e (for the fifth example). The circuit elements illustrated by symbols are represented by the common reference numeral for all examples, so as to avoid complication of the diagram and the explanation.

[First Configuration]

Figure 4:
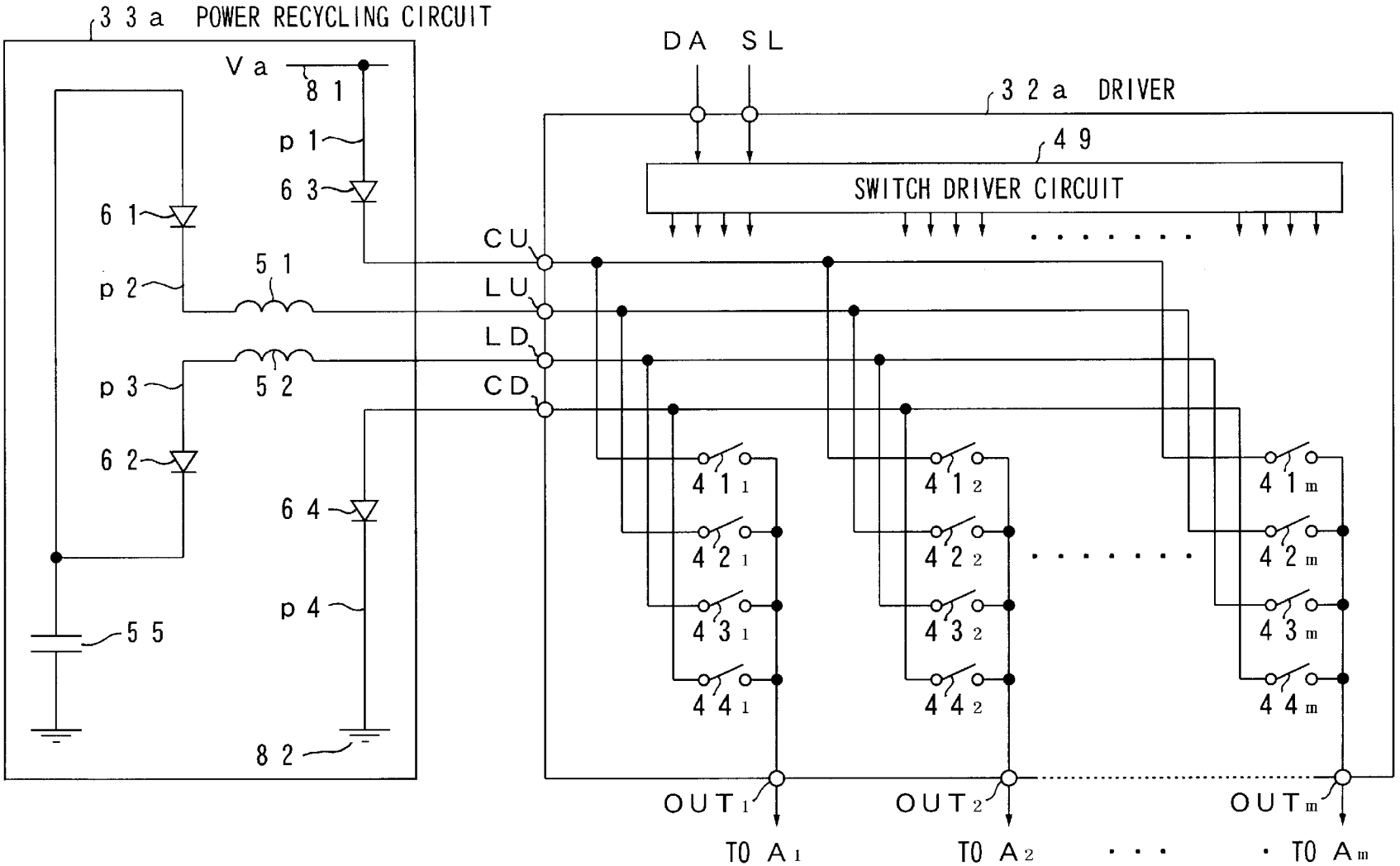
FIG. 4 shows a first example of the driving circuit.

FIG. 4 shows a first example of the driving circuit.

The driver 32*a* includes m output terminals $OUT_1$–$OUT_m$ each of which corresponds to each of m address electrode $A_1$–$A_m$, four connecting terminals CU, LU, LD and CD for connecting with the power recycling circuit 33*a*, 4×m switches $\mathbf{41}_1$–$\mathbf{41}_m$, $\mathbf{42}_1$–$\mathbf{42}_m$, $\mathbf{42}_1$–$\mathbf{42}_m$ and $\mathbf{42}_1$–$\mathbf{42}_m$, and switch driver circuit 49. Four switches 41, 42, 43 and 44 are disposed for each output terminal OUT, so that continuity between each output terminal OUT and each connecting terminal CU, LU, LD or CD can be controlled independently. The switch driver circuit 49 controls ON and OFF of the switches 41, 42, 43 and 44 in accordance with the above-mentioned control data DA. In order to avoid short circuit of the power supply, one of the switches 41 and 44 is ON while the other is OFF. The switches 42 and 43 are also selectively turned on.

The power recycling circuit 33*a* includes two inductors 51 and 52 for resonance, a capacitor 55 for recycling, diodes 61 and 62 for restricting the direction of the resonance current, and diodes 63 and 64 for protecting the power source. The diodes 63, 64 can be omitted. The capacitance of the capacitor 55 is preferably set to a sufficiently large value compared with the sum of the interelectrode capacitance $C_A$ accompanied with the m address electrode $A_1$–$A_m$ (see FIG. 3) so that voltage of the capacitor 55 hardly alters during power recycling operation. In addition, inductance values of the inductors 51 and 52 should be set so that the necessary time for charging and discharging becomes sufficiently short in the case of the maximum load where the target of charging and discharging is the sum of the interelectrode capacitance $C_A$.

More specifically, if the value of the interelectrode capacitance $C_A$ for one address electrode A is approximately 20 pF, the sum of the interelectrode capacitance $C_A$ for m=640 is approximately 0.00128 $\mu$F. In this case, the capacitor 55 having 10 $\mu$F will be sufficient. Furthermore, the practical range of the inductance values of the inductors 51 and 52 is 300–500 nH. However, the inductance values can be out of the range depending on the design giving a high priority to the charging and discharging time or the power recycling ratio.

The diode 63 is removed in the case where it is necessary to prevent the potential of the connecting terminal CU from being higher than the potential Va of the power supply line (bias potential line) 81. In the same manner, the diode 64 is removed if it is necessary to prevent the potential of the connecting terminal CD from being lower than the potential of the ground line 82.

In the addressing period TA explained with reference to FIG. 2, the driver 32*a* works as below.

A basic operation of the driver 32*a* is controlling ON and OFF of the switches 41 and 44 that are independent from each other for each output terminal OUT. In the addressing period TA, the switch 41 is turned on when applying the address pulse Pa to a certain address electrode A. Thus, the current path p1 from the power supply line 81 to the output terminal OUT via the connecting terminal CU is closed, and the output terminal OUT is biased to the potential Va. The switch 44 is turned on if the address pulse Pa is not applied. Thus, the current path p4 from the output terminal OUT to the ground line 82 via the connecting terminal CU is closed, and the output terminal OUT is connected to the ground. The driver 32*a* controls ON and OFF of the switches 42 and 43 as power recycling operation at the timing synchronized with ON and OFF of the switches 41 and 44.

In each output terminal OUT, the switch 42 is turned on before switch 41 is turned on. Thus, the resonance current path p2 is closed that runs from the capacitor 55 to the output terminal OUT via the inductor 51 and the connecting terminal LU. If the capacitor 55 has already been charged at this time point, current due to oscillation of the inductor 51 and the interelectrode capacitance $C_A$ flows from the capacitor 55 to the address electrode A, so the potential of the address electrode A rises. Namely, the accumulated charge of the capacitor 55 is used for charging the interelectrode capacitance $C_A$. After that, when the potential of the address electrode A approaches the bias potential Va, the switch 41 is turned on as mentioned above, so that charging of the interelectrode capacitance $C_A$ is supplemented by the power supply line 81, and the potential of the address electrode A becomes the bias potential Va. The supplement of charging is the power consumption concerning the interelectrode capacitance $C_A$.

Furthermore, in the output terminal OUT, the switch 43 is turned on before the switch 44 is turned on. Thus, the resonance current path p3 from the output terminal OUT to the capacitor 55 via the connecting terminal LD and the inductor 52 is closed. The current due to resonance of the inductor 52 and the interelectrode capacitance $C_A$ flows from the address electrode A to the capacitor 55, and the potential of the address electrode A drops. Namely, the accumulated charge of the interelectrode capacitance $C_A$ is collected by the capacitor 55. After that, when the potential of the address electrode A approaches the ground potential, the switch 44 is turned on as mentioned above. Then, the remaining charge of the interelectrode capacitance $C_A$ is released to the ground line 82 by the power supply line 81, and the potential of the address electrode A becomes the ground potential.

[Second Configuration]

Figure 5:
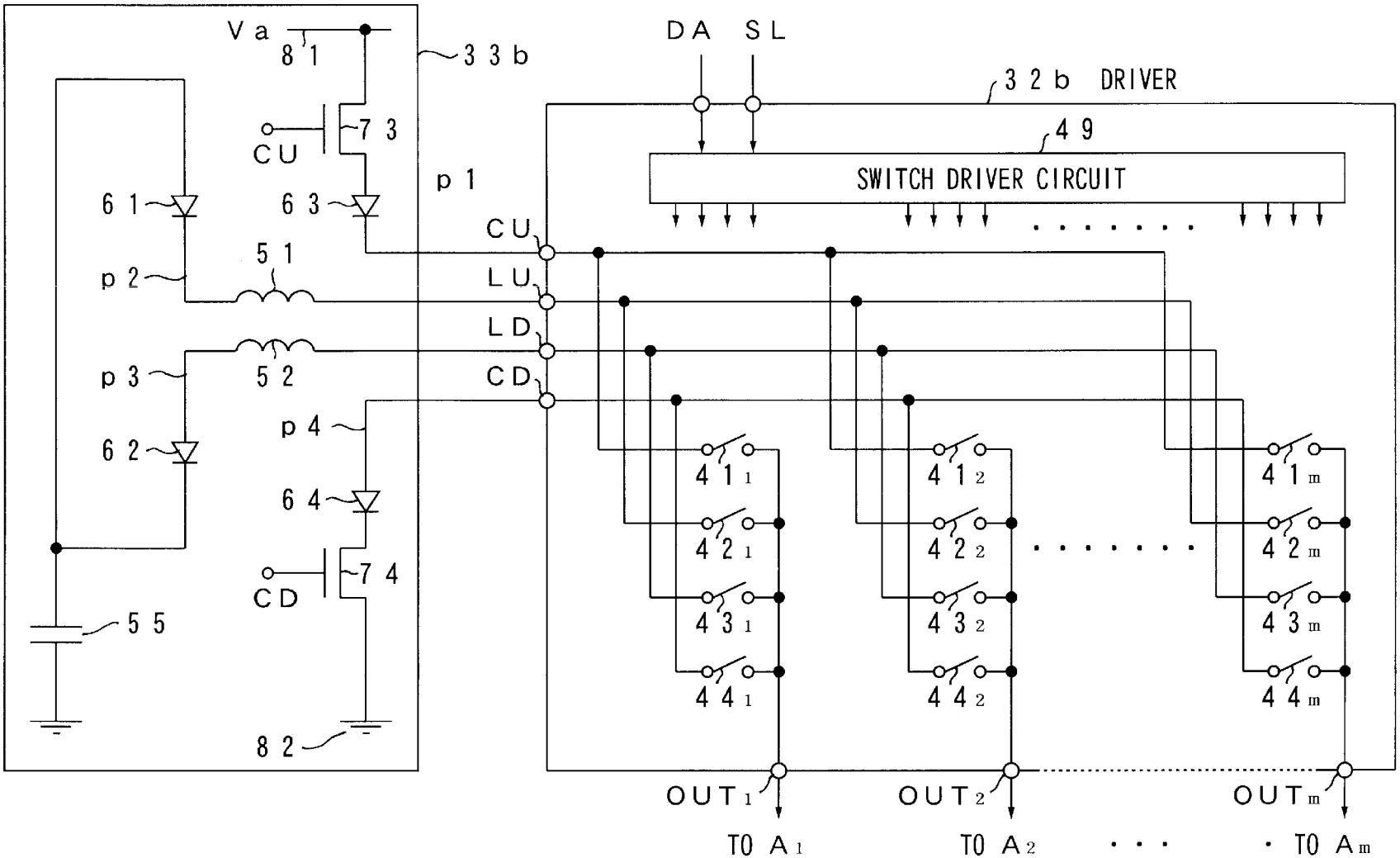
FIG. 5 shows a second example of the driving circuit.

FIG. 5 shows a second example of the driving circuit.

The block configuration of the driver 32*b* is the same as in the first example, so the explanation thereof is omitted. A distinct point of the second example is that the power recycling circuit 33*b* includes switches 73 and 74. The switch 73 is disposed between the power supply line 81 and the diode 63, and controls open and close of the current path p1 in accordance with the control signal CU. The switch 74 is disposed between the ground line 82 and the diode 64, and controls open and close of the current path p4 in accordance with the control signal CD. A switching device such as an FET is suitable for the switches 73 and 74. The control signals CU and CD are given by the controller 21 (see FIG. 1). The diodes 63 and 64 can be omitted in the same way as in the first configuration.

The circuit configuration for controlling the switches 41–44 can be simplified by disposing the switches 73 and 74.

It can be set independently whether the switches 41–44 are turned on or off. However, even in the configuration of the control circuit in which turning on and turning off are performed at the same timing, the switches 73 and 74 are turned off during the switch 42 or the switch 43 is turned on for reusing or collecting electric power. Then the switch 41 can be turned on at the same time as the switch 42, and the switch 44 can be turned on at the same time as the switch 43.

[Third Configuration]

Figure 6:
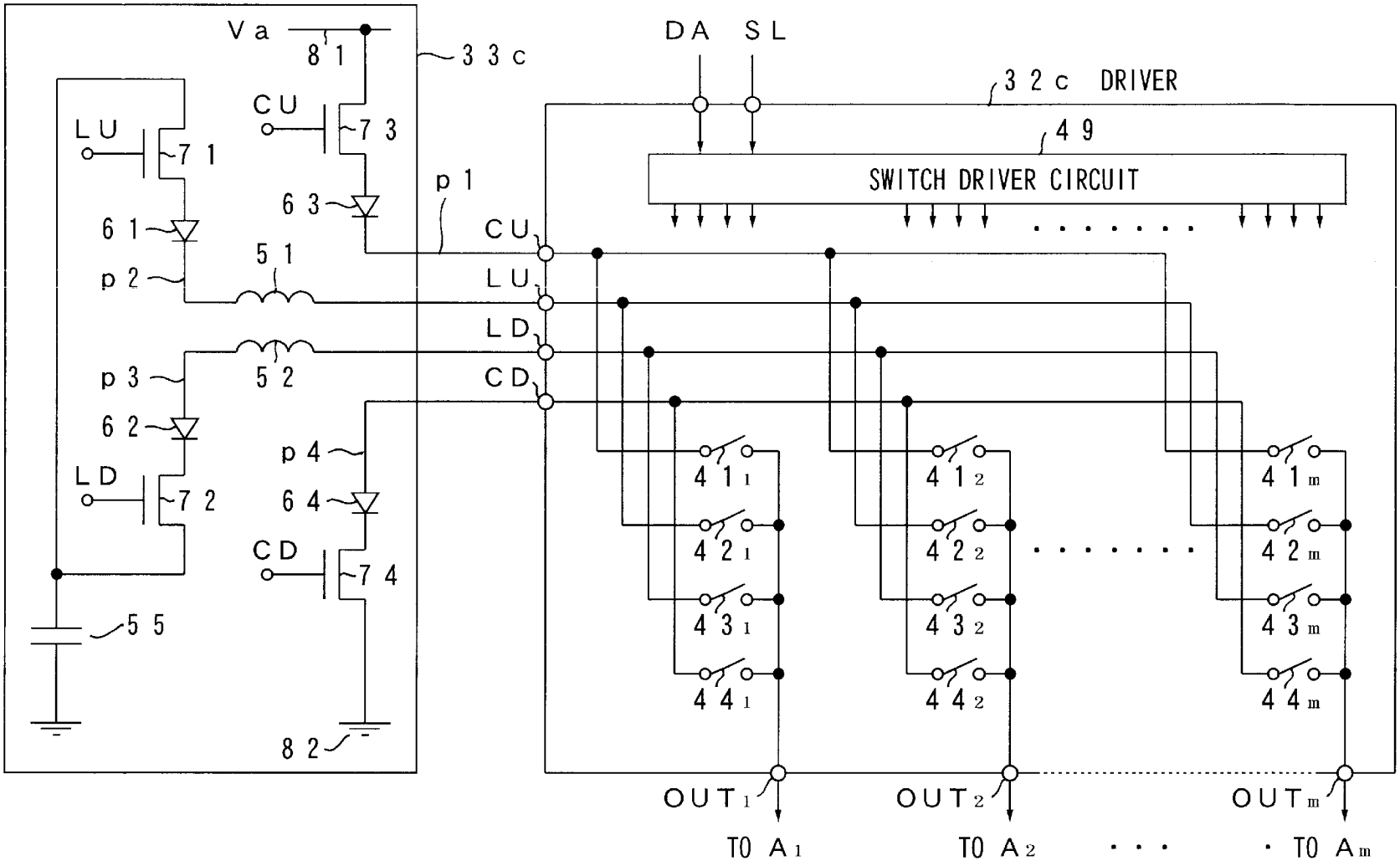
FIG. 6 shows a third example of the driving circuit.

FIG. 6 shows a third example of the driving circuit.

The block con-figuration of the driver 32*c* is the same as in the first example, so the explanation thereof is omitted. A distinct point of the third example is that the power recycling circuit 33*c* includes switches 71 and 72 adding to the switches 73 and 74. The switch 71 is disposed between the capacitor 55 and the diode 61, and controls open and close of the resonance current path2 in accordance with the control signal LU. The switch 72 is disposed between the diode 64 and the capacitor 55, and controls open and close of the resonance current path3 in accordance with the control signal LD. The control signals LU and LD are given by the controller 21 (see FIG. 1).

Providing the switches 71 and 72, start timing of the resonance current can be adjusted even if the switches 42, 43 have different characteristics between the output terminals OUT. The switch 71 or the switch 72 is turned on after turning on the switch 42 or the switch 43 corresponding to the output terminal OUT whose potential is to be switched.

[Fourth Configuration]

Figure 7:
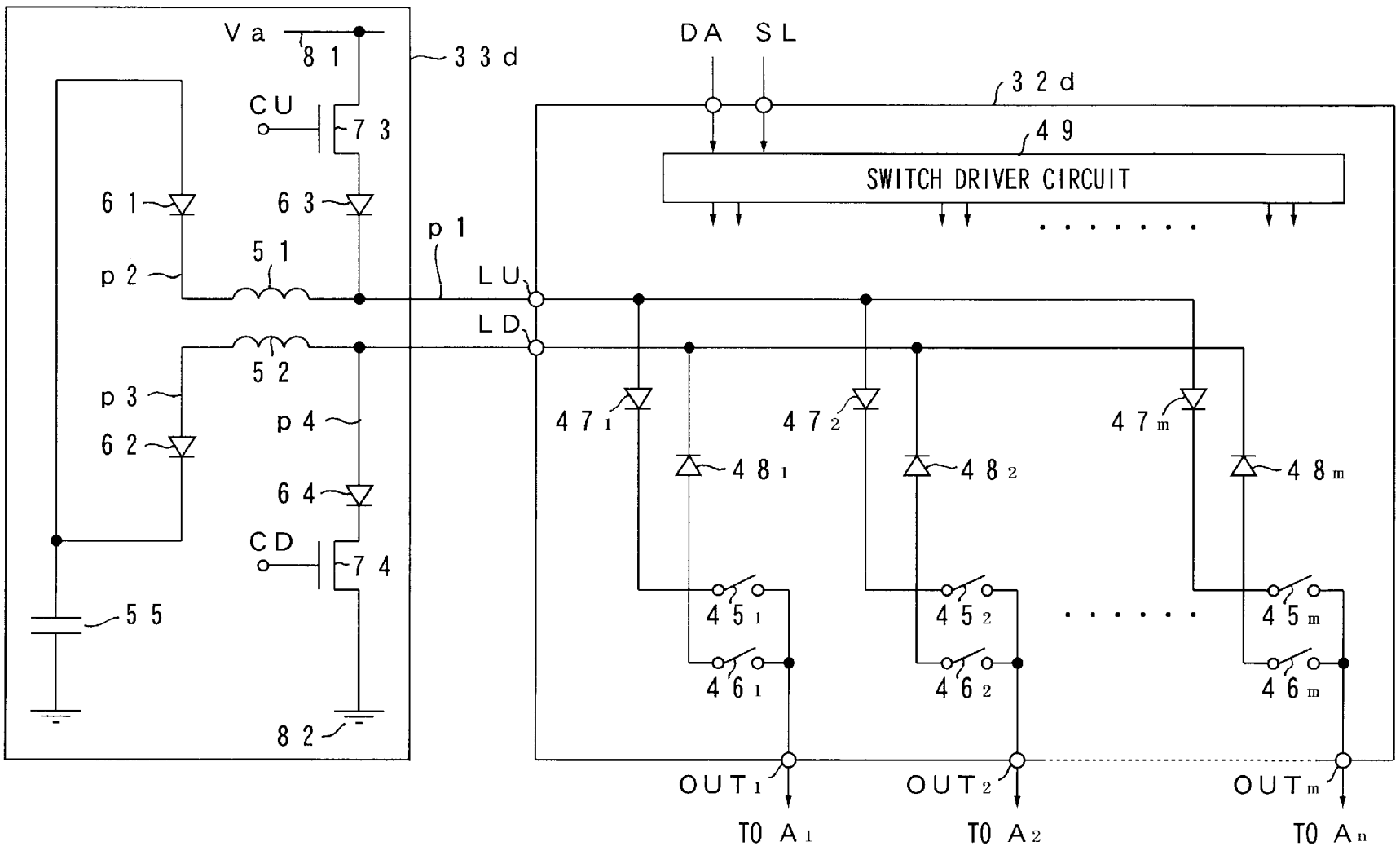
FIG. 7 shows a fourth example of the driving circuit.

FIG. 7 shows a fourth example of the driving circuit.

The driver 32*d* includes m output terminals $OUT_1$–$OUT_m$ each of which corresponds to each of m address electrode $A_1$–$A_m$, two connecting terminals LU and LD for connecting with the power recycling circuit 33*d*, 2×m switches $\mathbf{45}_1$–$\mathbf{45}_m$ and $\mathbf{46}_1$–$\mathbf{46}_m$, and switch driver circuit 49. Two switches 45 and 46 are disposed for each output terminal OUT, so that continuity between each output terminal OUT and each connecting terminal LU or LD can be controlled independently. The switch driver circuit 49 controls ON and OFF of the switches 45 and 46 in accordance with the above-mentioned control data DA. In order to avoid short circuit of the power source, one of the switches 45 and 46 is ON while the other is OFF.

The power recycling circuit 33*d* includes two inductors 51 and 52 for resonance, a capacitor 55 for recycling, diodes 61 and 62 for restricting the direction of the resonance current, and diodes 63 and 64 for protecting the power source. In this example too, the diode 63 is removed in the case where it is necessary to prevent the potential of the connecting terminal CU from being higher than the potential Va of the power supply line 81. In the same way, the diode 64 is removed if it is necessary to prevent the potential of the connecting terminal CD from being lower than the potential of the ground line 82.

In the addressing period TA explained with reference to FIG. 2, the driver 32*d* works as below.

An operation of the driver 32*d* is controlling ON and OFF of the switches 45 and 46 that are independent of each other for each output terminal OUT. In the addressing period TA, the switch 45 is turned on when applying the address pulse Pa to a certain address electrode A. Thus, the current path p3 from the capacitor 55 to the output terminal OUT via the inductor 51 and connecting terminal LU is closed. If the capacitor 55 has already been charged at this time point, current due to oscillation of the inductor 51 and the interelectrode capacitance $C_A$ flows from the capacitor 55 to the address electrode A, so the potential of the address electrode A rises. After that, when the potential of the address electrode A approaches the bias potential Va, the switch 73 is turned on so that the current path p1 from the power supply line 81 to the output terminal out via the connecting terminal LU is closed. Thus, the charging of the interelectrode capacitance $C_A$ is supplemented by the power supply line 81, and the potential of the address electrode A becomes the bias potential Va. The supplement of charging is the power consumption concerning the interelectrode capacitance $C_A$.

Furthermore, the switch 46 is turned on while the switches 73 and 74 are turned off when the address pulse Pa is not applied. Thus, the resonance current path p3 from the output terminal OUT to the capacitor 55 via the connecting terminal LD and the inductor 52 is closed. The current due to resonance of the inductor 52 and the interelectrode capacitance $C_A$ flows from the address electrode A to the capacitor 55, and the potential of the address electrode A drops. Namely, the accumulated charge of the interelectrode capacitance $C_A$ is collected by the capacitor 55. After that, when the potential of the address electrode A approaches the ground potential, the switch 74 is turned on so that the current path p4 from the output terminal OUT to the ground line 82 via the connecting terminal LD is closed. Thus, the remaining charge of the interelectrode capacitance $C_A$ is released to the ground line 82, and the potential of the address electrode A becomes the ground potential.

If the diodes 47 and 48 do not exist, a current pass that does not make up a resonance circuit is formed between the output terminals OUT when the switches 45 and 46 are turned on, so that the electric charge moves. Therefore, the potential of the connecting terminals LU and LD can be the same as that of the capacitor 55. In this case, neither collection nor reuse of electric power can be performed. Such a problem can be prevented by restricting the direction of the current by the diodes 47 and 48, so that the collection and the reuse of the electric power can be performed in parallel. However, even if the diodes 47 are 48 are omitted, potential difference can be generated between the connecting terminal LU or LD and the capacitor 55 when the number of the output terminals OUT as objects of discharge (collection) and the number of the output terminals OUT as objects of charge (reuse) are not the same. In this case, the collection or the reuse can be performed.

[Fifth Configuration]

Figure 8:
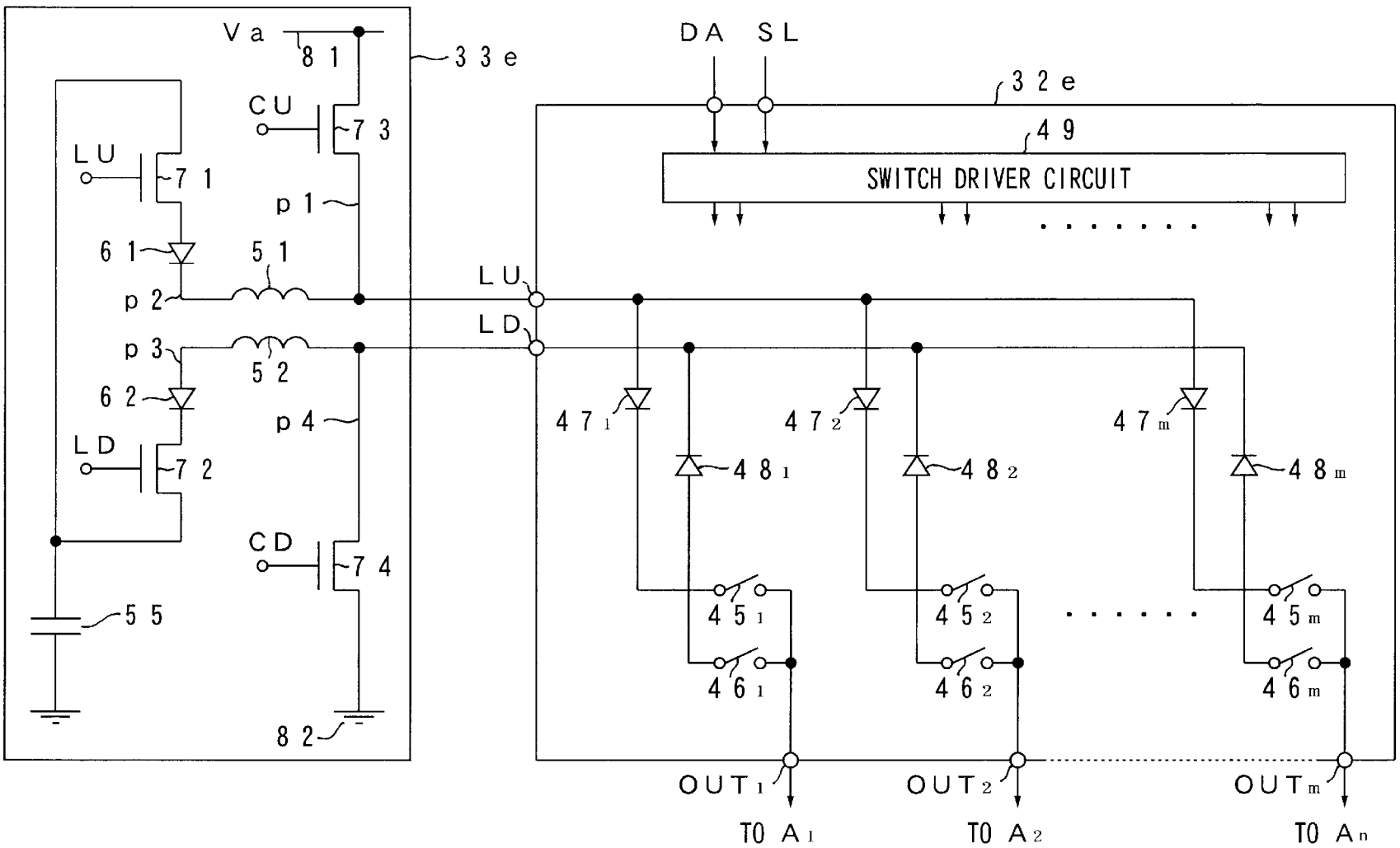
FIG. 8 shows a fifth example of the driving circuit.

FIG. 8 shows a fifth example of the driving circuit.

The block configuration of the driver 32*e* is the same as in the fourth example, so the explanation thereof is omitted. A distinct point of the fifth example is that the power recycling circuit 33*e* includes switches 71 and 72. The switch 71 is disposed between the capacitor 55 and the diode 61, and controls open and close of the resonance current path p2 in accordance with the control signal LU. The switch 72 is disposed between the diode 62 and the capacitor 55, and controls open and close of the resonance current path p3 in accordance with the control signal LD. The control signals LU and LD are given by the controller 21.

Providing the switches 71 and 72, start timing of the resonance current-can be adjusted even if the switches 45, 46 have different characteristics between the output terminals OUT. The switch 71 or the switch 72 is turned on after turning on the switch 45 or the switch 46 corresponding to the output terminal OUT whose potential is to be switched.

Next, a concrete example of the driver 32 will be explained.

Figure 9:
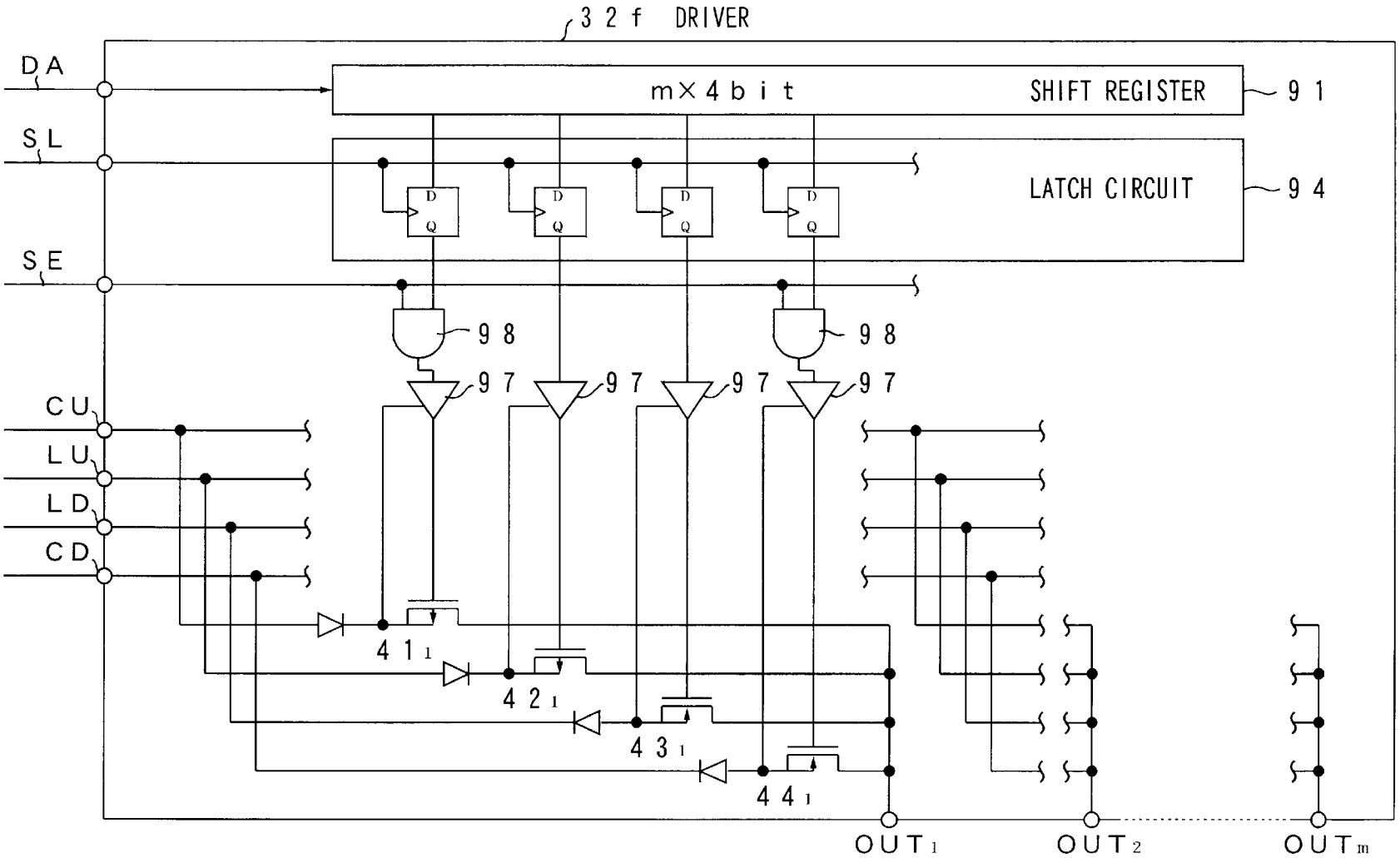
FIG. 9 shows a first example of the driver.
Figure 10:
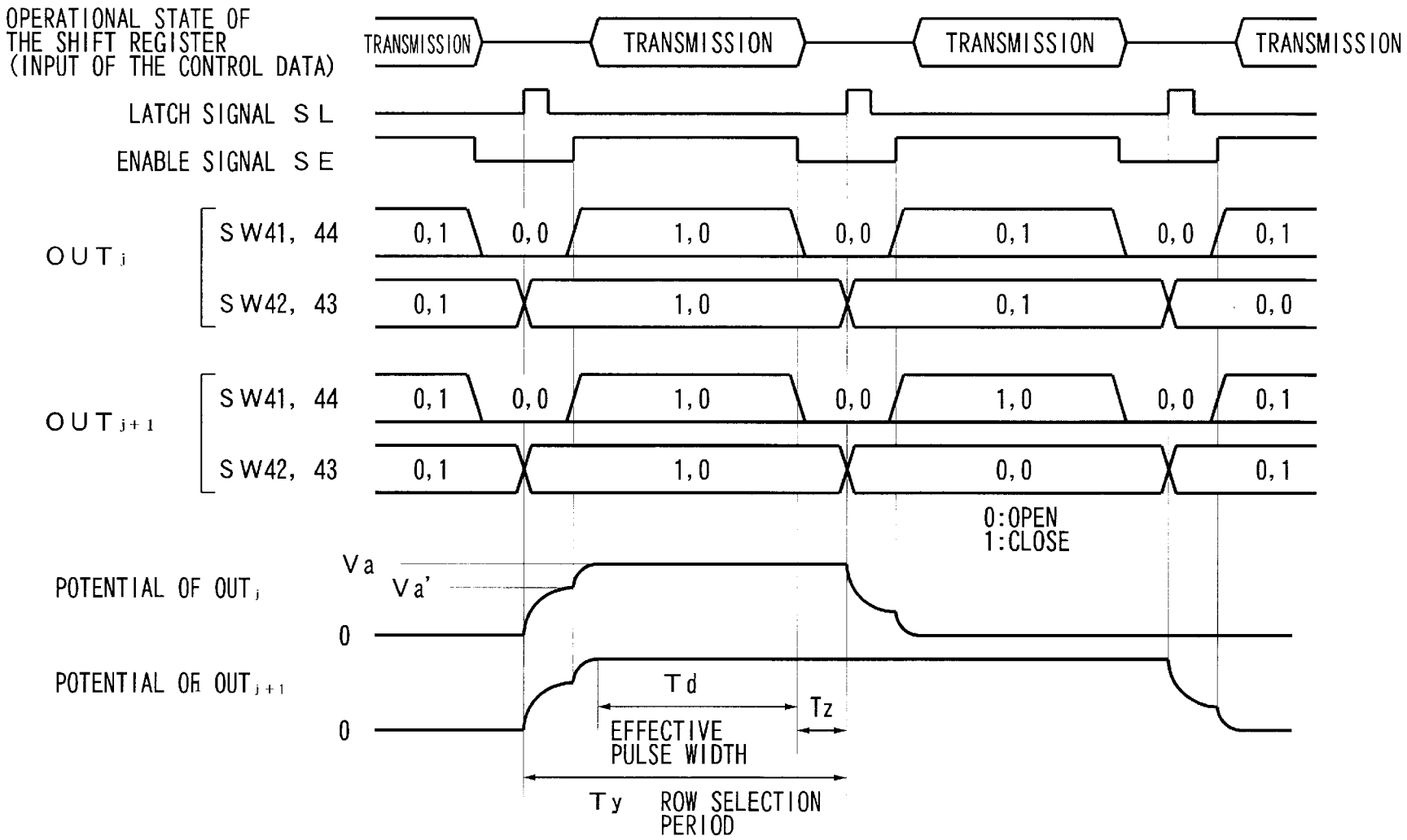
FIG. 10 is a time chart of the first example of the driver.

FIG. 9 shows a first example of the driver. FIG. 10 is a time chart of the first example of the driver. In FIG. 10 and other following time charts, switches are denoted by SW.

The driver 32*f* in FIG. 9 can be applied to the above-mentioned circuit configurations shown in FIGS. 4, 5 and 6. The driver 32*f* includes a shift register 91 for serial to parallel conversion of 4×m bits of control data DA, a latch circuit 94 for latching the 4×m bits of control data DA, 2×m AND circuits 98, and 4×m switch drivers 97 corresponding to the switches 41–44. The shift register 91, the latch circuit 94, the AND circuits 98 and the switch drivers 97 make up the above-mentioned switch driver circuit 49. The latch circuit 94 is a set of flip-flop circuits. Each output terminal OUT corresponds to four bits of the 4×m bits of control data DA that are latched by the latch circuit 94 responding to a latch signal SL, and these four bits are given to the switches 41–44 one bit by one bit. Each of the switches 41–44 includes an FET and a diode, and a control voltage is applied to the gate of the FET by the switch driver 97. The diode can be omitted. The switch driver 97 outputs a control voltage based on the source potential of the corresponding FET. The AND circuit 98 is provided for the switches 41 and 44, and transmits the control data DA from the latch circuit 94 to the switch driver 97 corresponding to the switches 41 and 44 only when an enable signal SE is active. The control data DA are given to the switch drivers 97 corresponding to the switches 42 and 43 directly from the latch circuit 94. Providing the AND circuit 98, all output terminals OUT can be separated from the power supply line 81 and the ground line 82 during collection and reuse of electric power, only by giving the binary enable signal SE from the controller 21.

FIG. 10 shows an example of addressing in which j-th output terminal $OUT_j$ and (j+1)th output terminal $OUTj_{j+1}$ are biased to the potential Va in a certain row selection period Ty, and the output terminal $OUT_j$ is backed to the ground potential during the next row selection period Ty while the output terminal $OUT_{j+1}$ is kept to the potential Va. After the potential of the terminals $OUT_j$ $OUT_{j+1}$ rises from the ground potential to the potential Va' due to the resonance, the period from the time point when the switch (SW) 41 is turned on (closes) so that the potential of the terminals $OUT_j$, $OUT_{j+1}$ rises from the potential Va' to the potential Va, to the time point when the switch 41 is turned off makes the effective pulse width Td of the address pulse Pa. During the period Tz from turn-off of the switch 41 to turn-on of the switch 42 for starting recycling, the output terminal OUT keeps high impedance state.

In this example, the four switches 41–44 corresponding to the address electrodes A can be controlled independently, so that an optimum timing can be given for switching and keeping the potential. In addition, since the collection and the reuse of the electric power can be performed simultaneously by using external inductances 51, 52, the effective pulse width Td can be sufficiently long.

Figure 11:
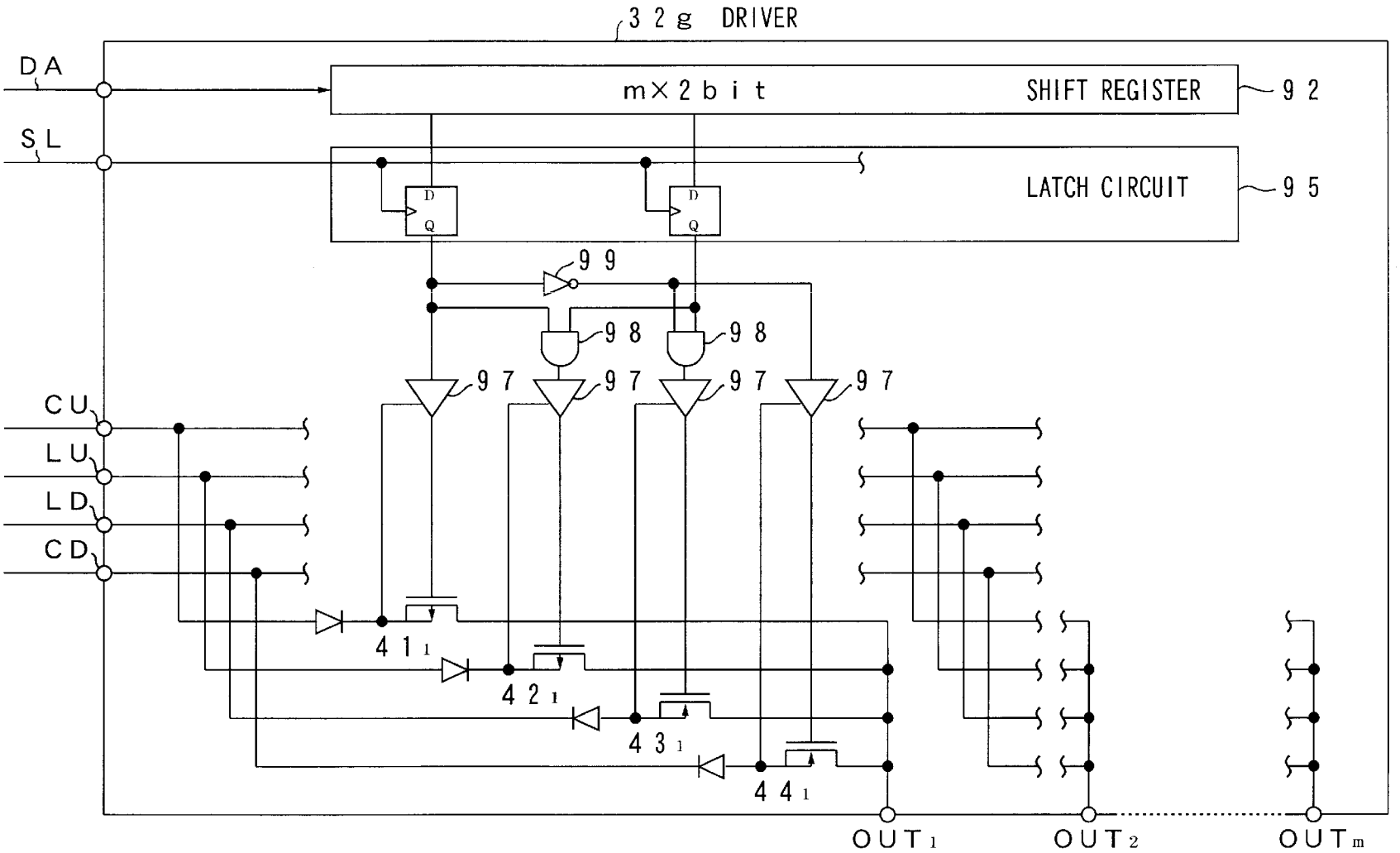
FIG. 11 shows a second example of the driver.
Figure 12:
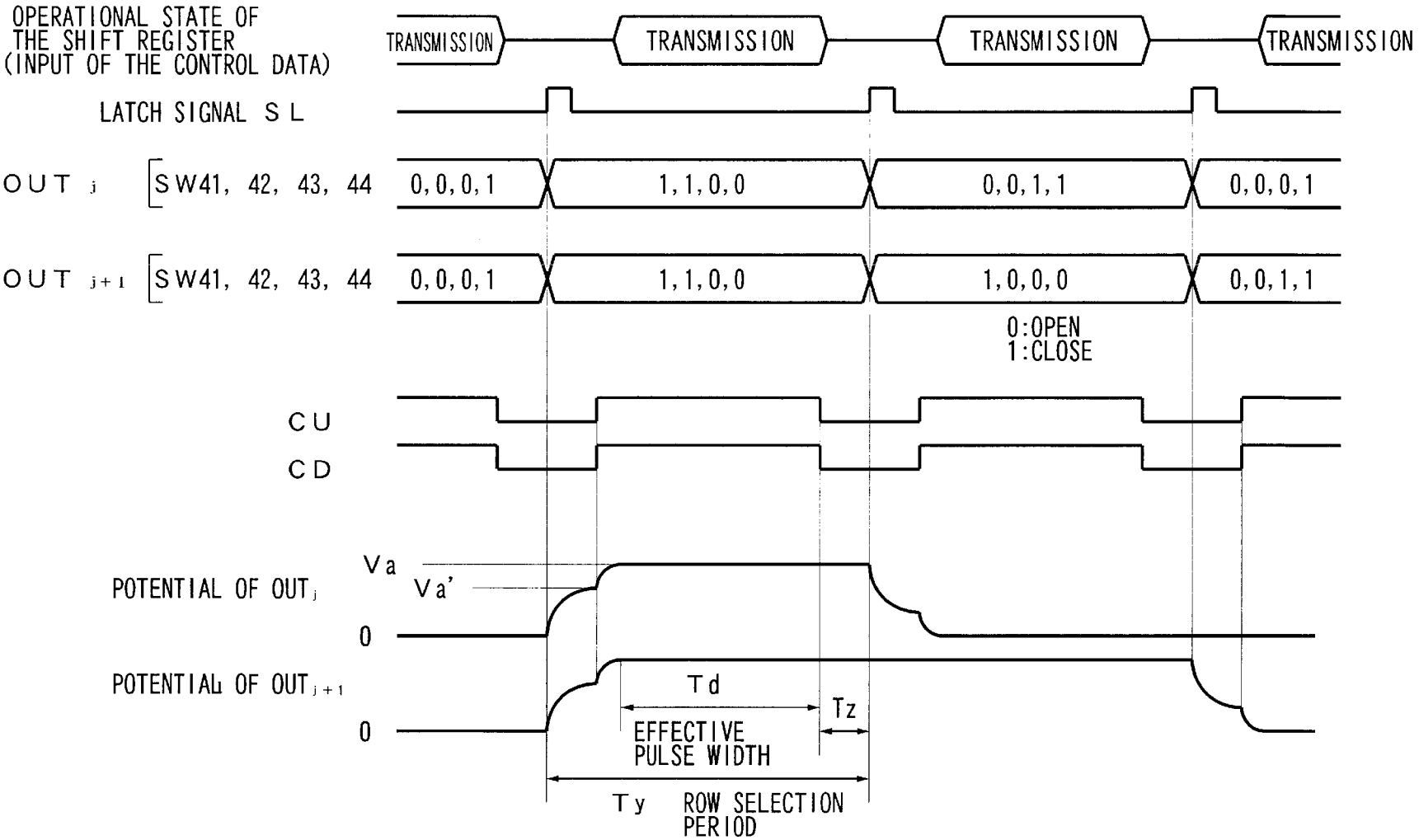
FIG. 12 is a time chart of the second example of the driver.

FIG. 11 shows a second example of the driver, and FIG. 12 is a time chart of the second example of the driver.

The driver 32*g* in FIG. 11 can be applied to the above-mentioned circuit configurations shown in FIGS. 4, 5 and 6.

The driver 32*g* includes a shift register 92 for serial to parallel conversion of 2×m bits of control data DA, a latch circuit 95 for latching the 2×m bits of control data DA, m inverters 99, 2×m AND circuits 98, and 4×m switch drivers 97 corresponding to the switches 41–44. The shift register 92, the latch circuit 95, the inverters 99, the AND circuits 98 and the switch drivers 97 make up the above-mentioned switch driver circuit 49. Each output terminal OUT corresponds to two bits of the 2×m bits of control data DA that are latched by the latch circuit 95 responding to a latch signal SL, and the switches 41–44 are controlled in accordance with these two bits. A first bit is given to the switch 41 directly, while the bit is given to the switch 44 after inverted by the inverter 99. An AND signal of the first and the second bits obtained by the AND circuit 98 is given to the switch 42. An AND signal of the second bit and the inverted signal of the first bit is given to the switch 43. The control data DA indicate that the output is one when the first bit is one, the output is not changed when the second bit is zero, and the output is changed when the second bit is one. In this example, the switches 41–44 can be controlled at the same timing by using the external switches 73 and 74. In addition, the states of the switches 41–44 includes only four combinations, which are (1, 1, 0, 0), (0, 0, 1, 1), (1, 0, 0, 0) and (0, 0, 0, 1) where "0" represents closing and "1" represents opening. Since the number of bits for the shift register and the latch circuit is the half of that in the example shown in FIG. 9, the present example, which is the best example of the present invention, has an advantage in packing the circuit into an IC chip.

Figure 13:
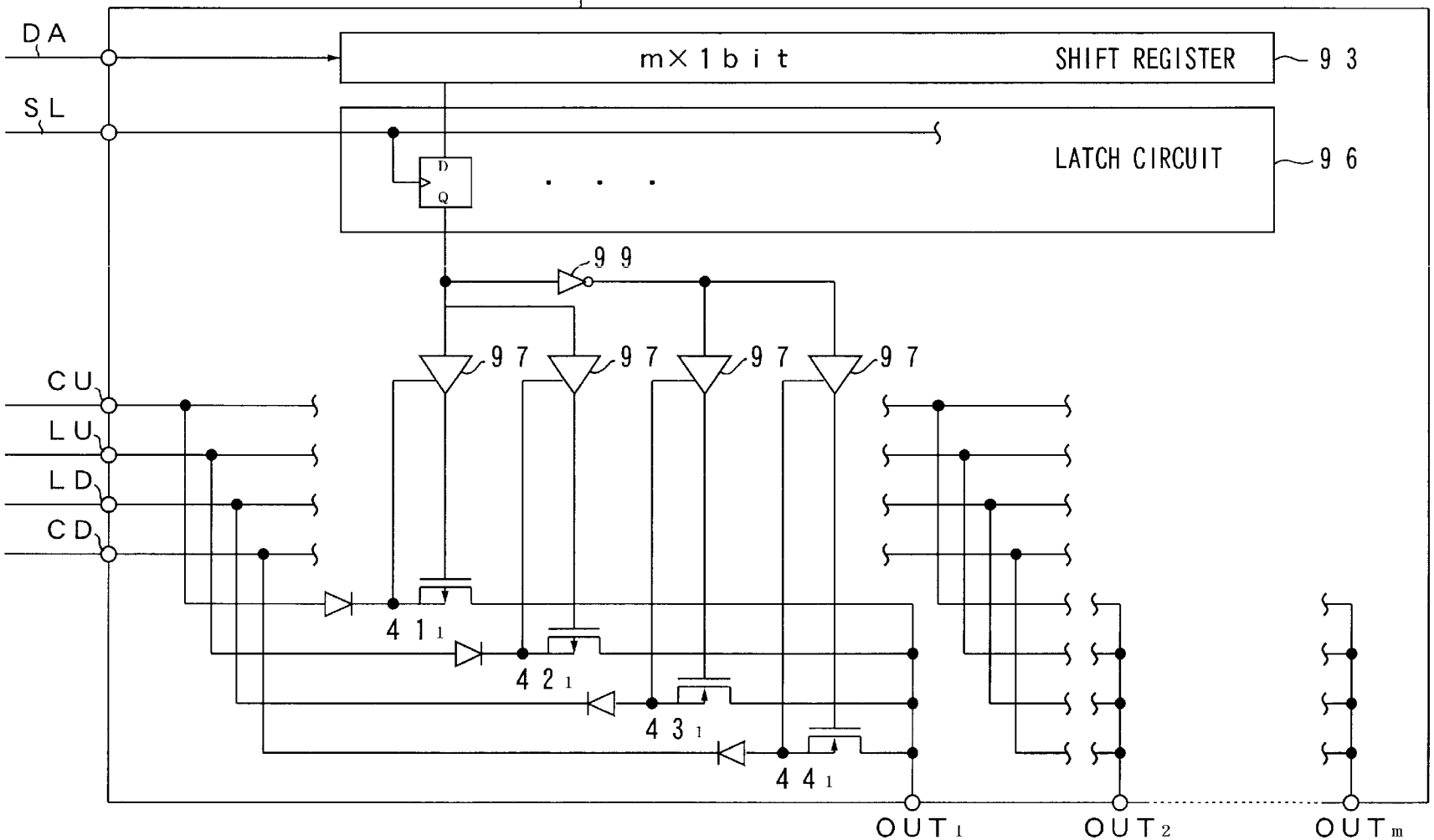
FIG. 13 shows a third example of the driver.
Figure 14:
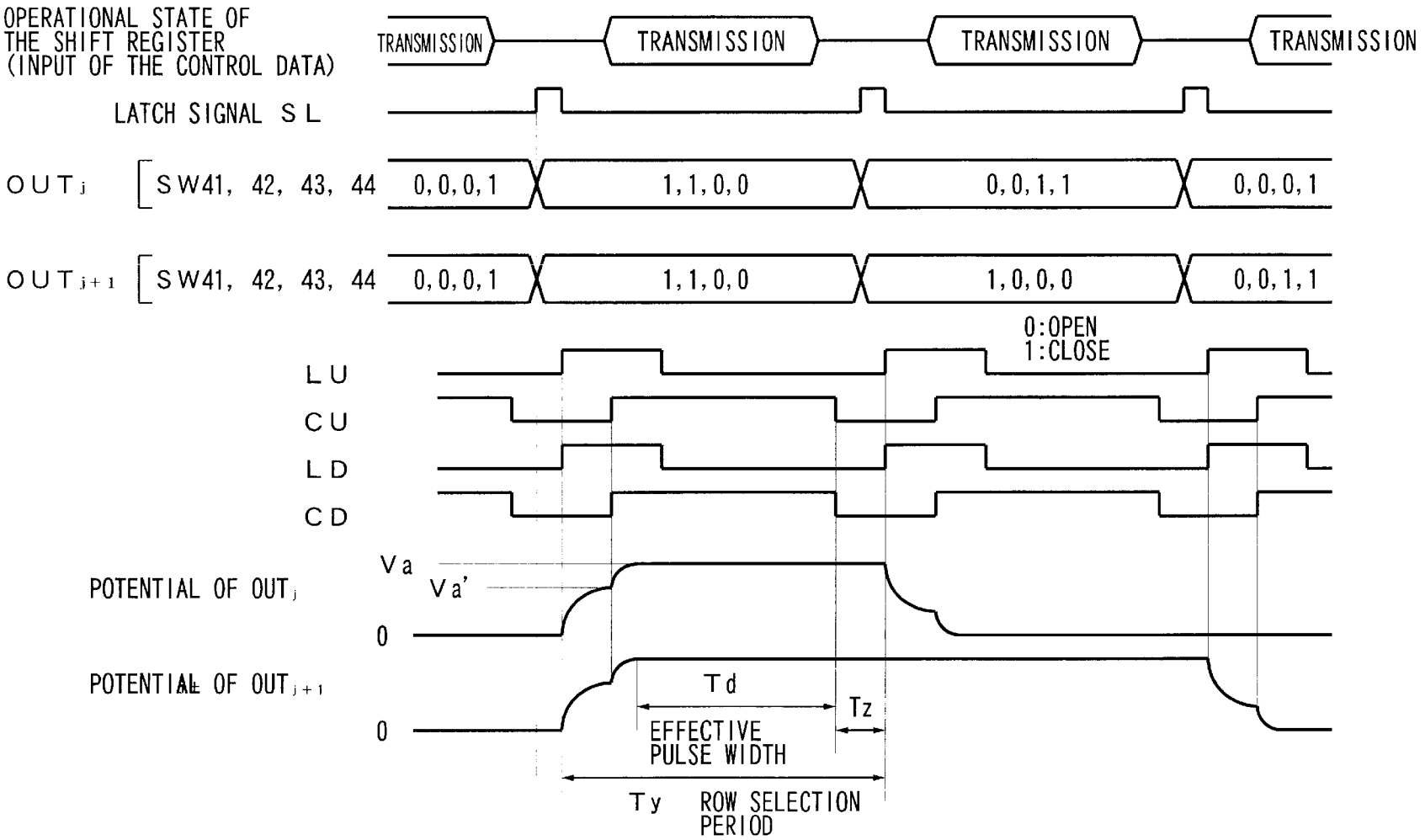
FIG. 14 is a time chart of the third example of the driver.

FIG. 13 shows a third example of the driver, and FIG. 14 is a time chart of the third example of the driver.

The driver 32*h* in FIG. 13 can be applied to the above-mentioned circuit configurations shown in FIGS. 5 and 6. The driver 32*h* includes a shift register 93 for serial to parallel conversion of 1×m bits of control data DA, a latch circuit 96 for latching the 1×m bits of control data DA, m inverters 99, and 4×m switch drivers 97 corresponding to the switches 41–44. The shift register 93, the latch circuit 96, the inverters 99 and the switch drivers 97 make up the above-mentioned switch driver circuit 49. Each output terminal OUT corresponds to one bit of the 1×m bits of control data DA that are latched by the latch circuit 96 responding to a latch signal SL, and the switches 41–44 are controlled in accordance with this one bit. The one bit is given to the switches 41 and 42 directly, while the bit is given to the switches 43 and 44 after inverted by the inverter 99. The timings of ON and OFF of the switches 41 and 42 are the same, and timings of ON and OFF of the switches 43 and 44 are the same.

In this example, the switches 41–44 can be controlled at the same timing by using the external switches 73 and 74. In addition, since each bit of the control data DA is used for two switches, the number of bits for the shift register and the latch circuit is one fourth of that in the example shown in FIG. 9.

In the above-mentioned switches 41 and 44 shown in FIGS. 9, 11 and 13, the diode connected to the FET in series can be removed if it is necessary to prevent the potential of the output terminal OUT from being higher than Va, or from being lower than the ground potential. Furthermore, the diode connected to the FET in the switches 42 and 43 can be omitted, if it is provided to the external power recycling circuit 33.

Figure 15:
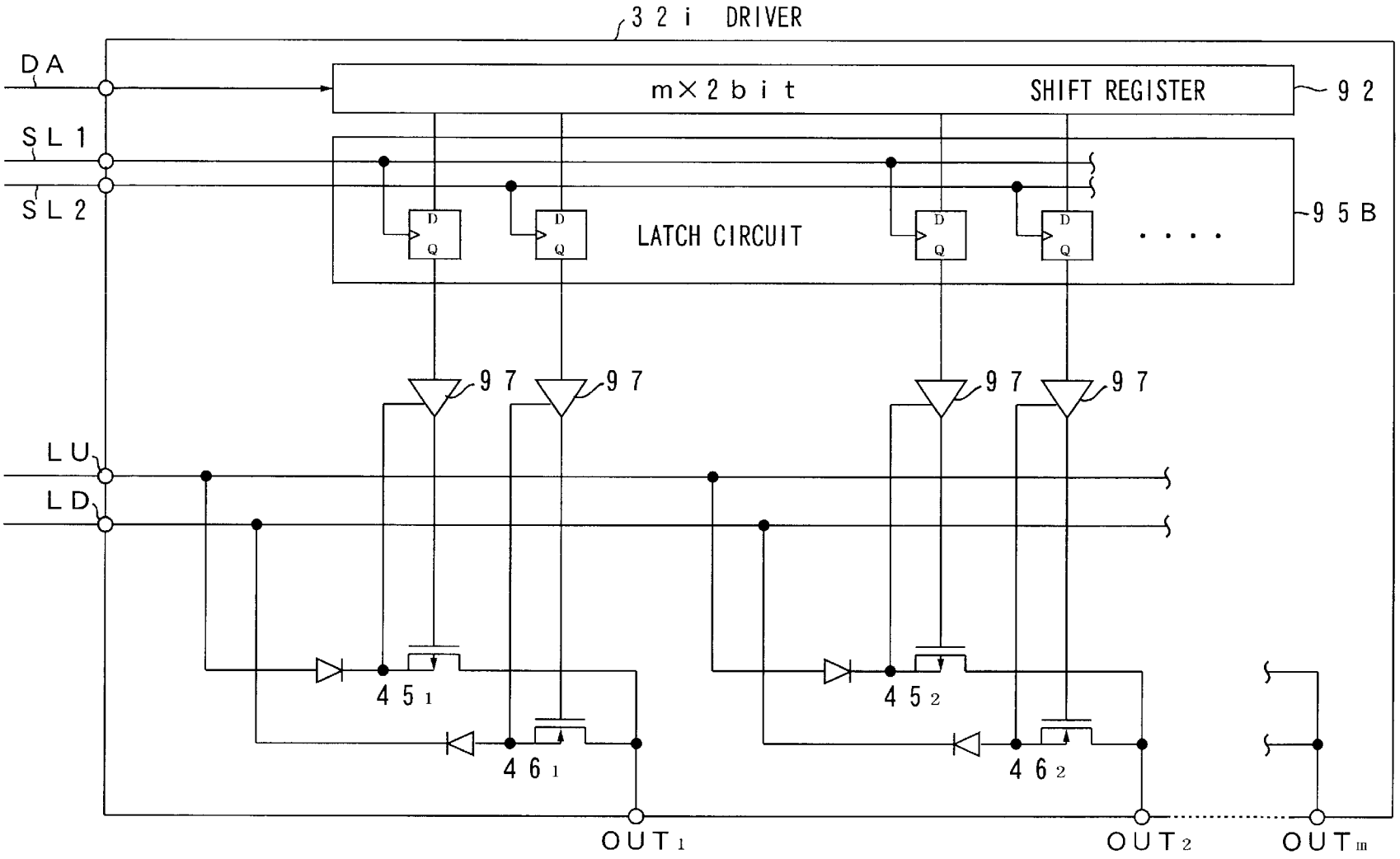
FIG. 15 shows a fourth example of the driver.
Figure 16:
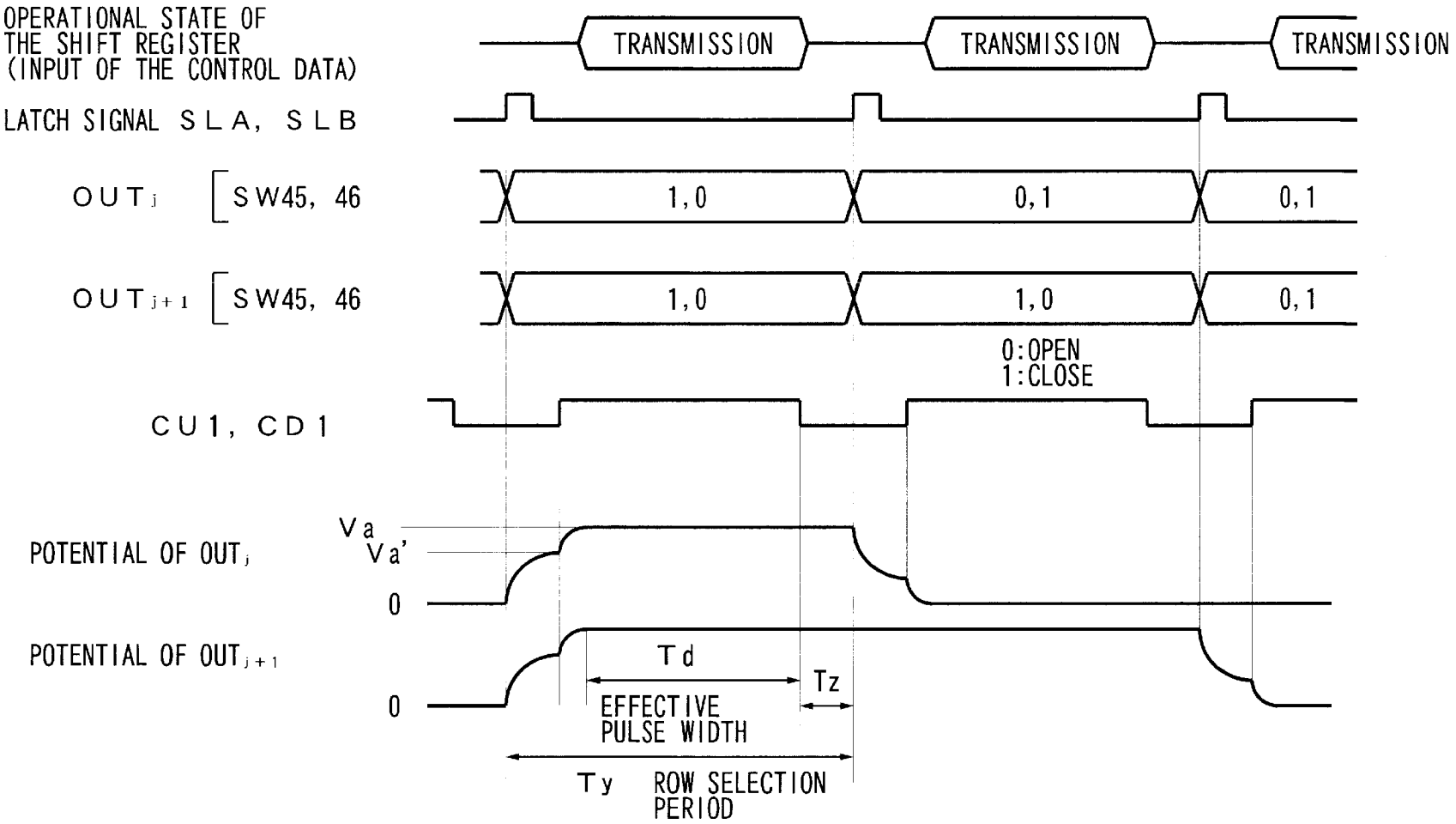
FIG. 16 is a time chart of the fourth example of the driver.

FIG. 15 shows a fourth example of the driver, and FIG. 16 is a time chart of the fourth example of the driver.

The driver 32*i* in FIG. 15 can be applied to the above-mentioned circuit configurations shown in FIGS. 7 and 8. The driver 32*i* includes a shift register 92 for serial to parallel conversion of 2×m bits of control data DA, a latch circuit 95B for latching the 2×m bits of control data DA, and 2×m switch drivers 97 corresponding to the switches 41–44. The shift register 92, the latch circuit 95B and the switch drivers 97 make up the above-mentioned switch driver circuit 49. Each output terminal OUT corresponds to tow bits of the 2×m bits of control data DA that are latched by the latch circuit 95B. One bit of the two bits that is latched responding to a latch signal SL1 is given to the switch 45, and the other bit that is latched responding to a latch signal SL2 is given to the switch 46. Each of the switches 45 and 46 includes an FET and a diode, and a control voltage is applied to the gate of the FET by the switch driver 97. The switch driver 97 outputs a control voltage based on the source potential of the corresponding FET.

Figure 17:
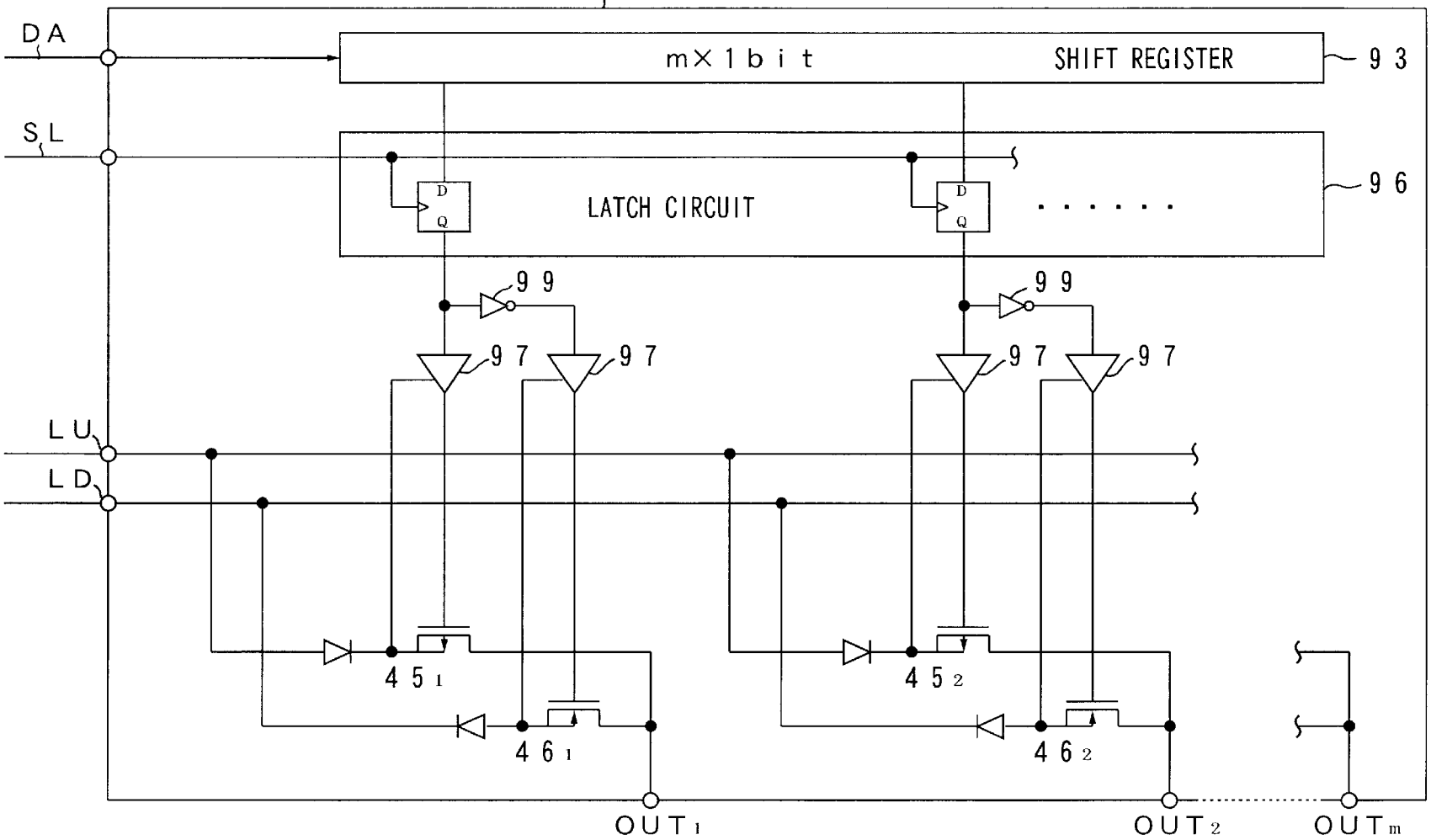
FIG. 17 shows a fifth example of the driver.
Figure 18:
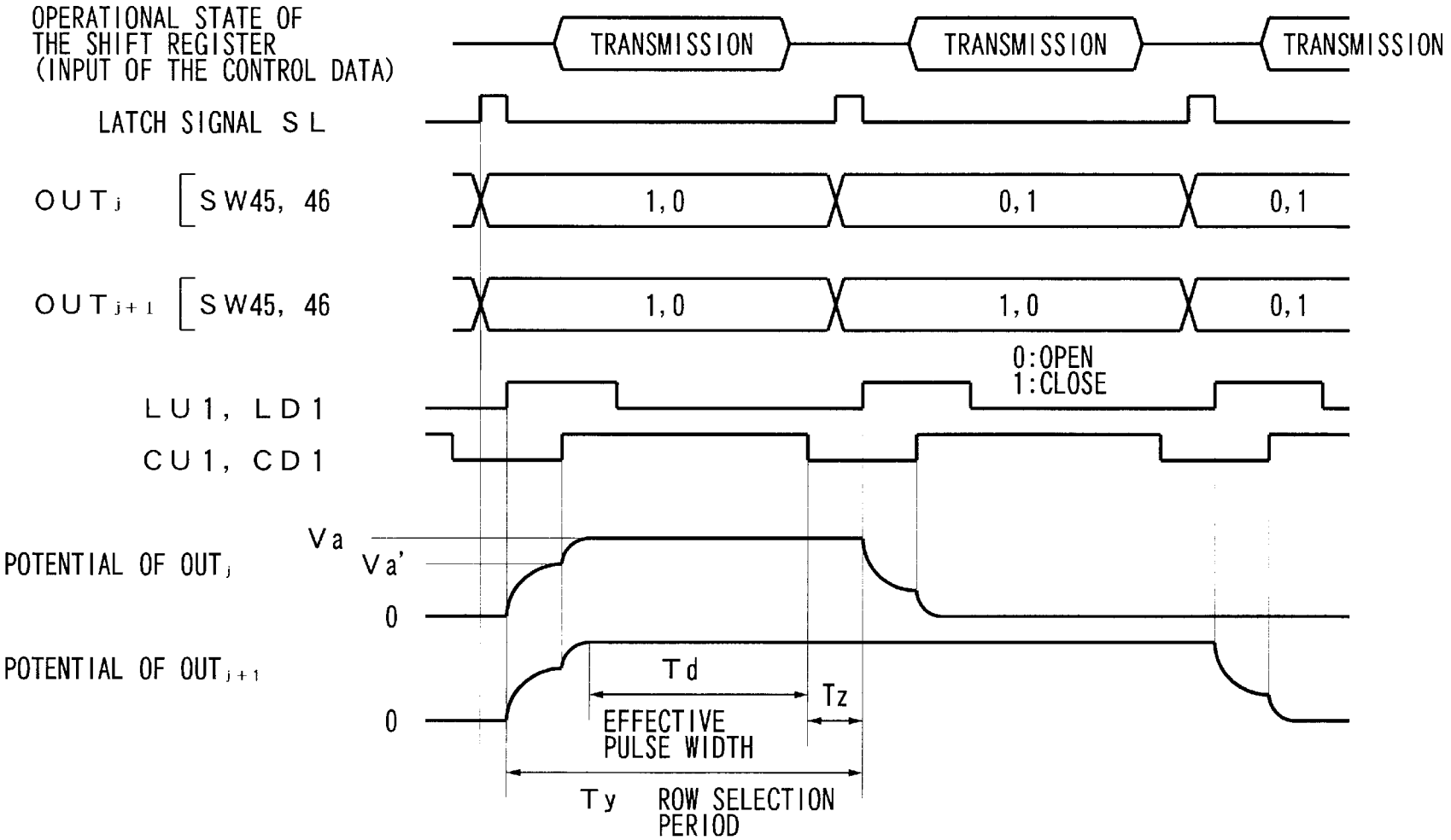
FIG. 18 is a time chart of the fifth example of the driver.

FIG. 17 shows a fifth example of the driver, and FIG. 18 is a time chart of the fifth example of the driver.

The driver 32*j* in FIG. 17 can be applied to the above-mentioned circuit configurations shown in FIG. 8. The driver 32*j* includes a shift register 93 for serial to parallel conversion of 1×m bits of control data DA, a latch circuit 96 for latching the 1×m bits of control data DA, m inverters 99, and 2×m switch drivers 97 corresponding to the switches 41–44. The shift register 93, the latch circuit 96, the inverters 99 and the switch drivers 97 make up the above-mentioned switch driver circuit 49. Each output terminal OUT corresponds to one bit of the 1×m bits of control data DA that are latched by the latch circuit 96, and the switches 45 and 46 are controlled in accordance with this one bit. The one bit is given to the switch 45 directly, and the bit is given to the switch 46 after inverted by the inverter 99. The timing of ON and OFF of the switches 45 and 46 are the same.

In the above-mentioned circuit configuration, the control signals CU, CD, LU and LD can be generated by reading waveforms at a predetermined timing that was memorized in a ROM. Alternatively, it may be judged whether the output of the control signals CU, CD, LU and LD is necessary or not, in accordance with the subfield data Dsf, and the output is performed in accordance with the result of the judgement. Though examples were explained in which the number of the switches per one address electrode A is two or four, the number can be k that is equal to or more than two. The switch in the driver 32 is not limited to a transistor and a diode connected in series, but can be anything that has switching function.

Figure 19:
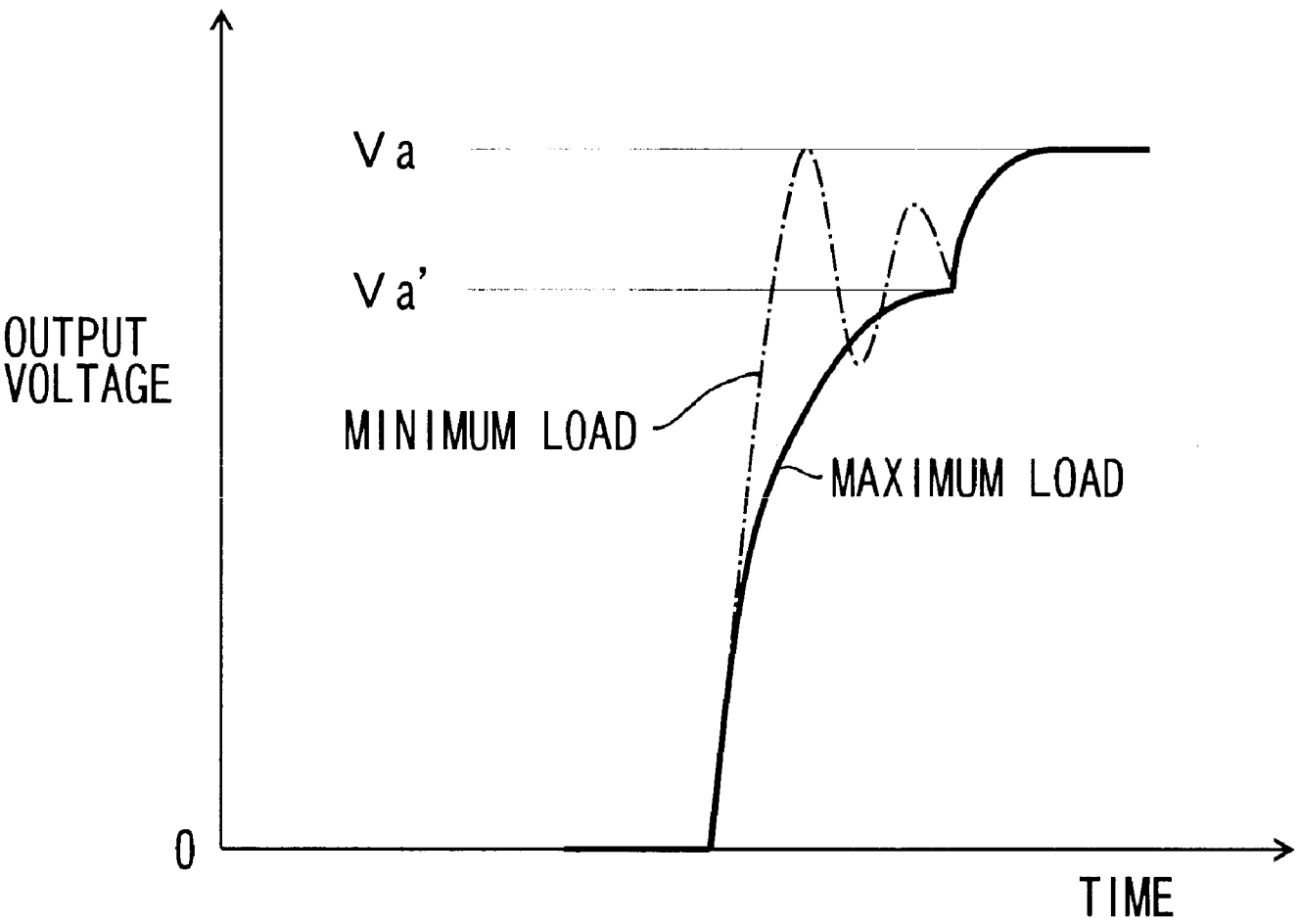
FIG. 19 shows the relationship between the load and the recycling efficiency.

FIG. 19 shows the relationship between the load and the recycling efficiency.

In the circuit configuration of the present invention, the inductance of the power recycling circuit 33 is fixed. Since the number (load) of the address electrode A that is targets of power collection and reuse varies in accordance with the display data, the resonance frequency is not stable. However, selecting the inductance of the inductors 51 and 52 in accordance with the maximum load as mentioned above, a practical recycling efficiency can be obtained regardless of the load variation. Though the load variation generates distortion of the waveform at the rising and falling edges, the resonance can transit the potential of the electrode to the same potential as in the maximum load even if it is the minimum load. If the effective pulse width Td is sufficiently long, the address discharge can be generated securely regardless of the edge distortion of the address pulse Pa by adjusting the timing with the potential control of the main electrode Y.

According to the invention, the power consumption due to the interelectrode capacitance in the addressing period can be reduced securely by power recycling circuits less than data electrodes.

According to the invention, four switches corresponding to data electrodes does not need to be controlled at different timings, so the control circuit can be simplified by using the common timing.

According to the invention, even if the switches corresponding to plural data electrodes have different state transition characteristics, resonance can be generated in the same manner as in the case where they have the same state transition characteristics.

According to the invention, power collection and reuse can be performed also in the case where the number of the data electrode to be charged is substantially the same as the number of the data electrode to be discharged.

According to the invention, even if the switches corresponding to plural data electrodes have different state transition characteristics, resonance can be generated in the same manner as in the case where they have the same state transition characteristics.

According to the invention, power collection and reuse can be performed also in the case where the number of the data electrode to be charged is substantially the same as the number of the data electrode to be discharged.

What is claimed is:

1. A method for driving a display panel by controlling potential for selective addressing of electrodes arranged within a screen, the method comprising the steps of:

providing first to fourth switches for each of plural data electrodes controlled by display data;

using the first switch for making or breaking a current path from a bias potential line to a data electrode corresponding to the first switch;

using the second switch for making or breaking a first resonance current path from a power recycling capacitor to a data electrode corresponding to the second switch;

using the third switch for making or breaking a second resonance current path from a data electrode corresponding to the third switch to the capacitor;

using the fourth switch for making or breaking a current path from a data electrode corresponding to the fourth switch to a ground potential line;

connecting all of the first switches to the bias potential line via a bias controlling switch;

connecting all of the fourth switches to the ground potential line via a ground controlling switch;

connecting all of the second switches to the capacitor via a first auxiliary switch;

connecting all of the third switches to the capacitor via a second auxiliary switch;

controlling all of the first switches depending on display data in one line prior to controlling the bias controlling switch so as to start supplying current from the bias potential line to the plural data electrodes simultaneously each time selective addressing for the line is performed;

controlling all of the second switches depending on display data in one line prior to controlling the ground controlling switch so as to start supplying current from the plural data electrodes to the ground potential line simultaneously each time selective addressing for the line is performed;

controlling all of the third switches depending on display data in one line prior to controlling the first auxiliary switch so as to start supplying current from the capacitor to the plural data electrodes simultaneously each time selective addressing for the line is performed; and controlling all of the fourth switches depending on display data in one line prior to controlling the second auxiliary switch so as to start supplying current to the capacitor from the plural data electrodes simultaneously, each time selective addressing for the line is performed.

2. The method according to claim 1, wherein the first auxiliary switch and the second auxiliary switch are controlled at the same timing.

3. An integrated circuit device controlling potentials of m ($m \geqq 2$) data electrodes arranged within a screen of a display panel, comprising:

m output terminals, each corresponding to each of the m data electrodes;

four connecting terminals for connecting to an external power recycling circuit;

4×m switches for controlling continuity between each of the m output terminals and each of the four connecting terminals; and a switch driver circuit for controlling the 4×m switches, wherein the switch driver circuit includes a register that can memorize 4×m bits of control data and outputs four bits of the control data, corresponding, to each one of the m output terminals, to four respective switches corresponding to the one output terminal, one bit by one bit.

4. An integrated circuit device controlling potentials of m ($m \geqq 2$) data electrodes arranged within a screen of a display panel, comprising:

m output terminals, each of which corresponds to each of the m data electrodes;

four connecting terminals for connecting to an external power recycling circuit;

4×m switches for controlling continuity between each of the m output terminals and each of the four connecting terminals; and a switch driver circuit for controlling the 4×m switches, wherein the switch driver circuit includes a signal gate for forcing the two of four switches, corresponding to each one of the m output terminals, to be in the open state responding to an external control signal; and a register that can memorize 4×m bits of control data, and outputs four bits of the control data, corresponding to each one of the m output terminals to four respective switches corresponding to the one output terminal, one bit by one bit.

5. An integrated circuit device controlling potentials of m ($m \geqq 2$) data electrodes arranged within a screen of a display panel, comprising:

m output terminals, each of which corresponds to each of the m data electrodes;

four connecting terminals for connecting to an external power recycling circuit;

4×m switches for controlling continuity between each of the m output terminals and each of the four connecting terminals; and a switch driver circuit for controlling the 4×m switches, wherein the switch driver circuit includes a register that can memorize 2×m bits of control data, and generates four bits of data in accordance with two bits corresponding to each one of the m output terminals so as to output the data to four respective switches corresponding to the one output terminal, one bit by one bit.

6. An integrated circuit device for controlling potentials of m ($m \geqq 2$) data electrodes arranged within a screen of a display panel, comprising:

m output terminals, each of which corresponds to each of the m data electrodes;

two connecting terminals for connecting to an external power recycling circuit;

2×m switches for controlling continuity between each of the m output terminals and each of the two connecting terminals; and a switch driver circuit for controlling the 2×m switches, wherein the switch driver circuit includes a register that can memorize 2×m bits of control data, and gives two bits of the control data corresponding to each of the m output terminals to two switches corresponding to the one output terminal one by one bit.

7. A display device comprising:

a display panel including M ($2 \leqq M \leqq m \times k$, m is an integer greater than one and k is an integer greater than zero) data electrodes and N ($2 \leqq N$) scan electrodes arranged within a screen;

a driving device controlling potentials of the data electrodes and the scan electrodes for selective addressing;

the driving device including an address driver circuit comprising k integral circuit devices and i ($1 \leqq i \leqq k$) power recycling circuits;

the power recycling circuit including first and second inductance elements for resonance with the capacitance within the screen, wherein the integrated circuit device includes m output terminals, each of which corresponds to each of the m data electrodes, four connecting terminals for connecting to an external power recycling circuit, 4×m switches for controlling continuity between each of the m output terminals and each of the four connecting terminals and a switch driver circuit for controlling the 4×m switches; and the switch driver circuit including a register that can memorize 4×m bits of control data and outputting four bits of the control data corresponding to each one of the m output terminals to four switches corresponding to the one output terminal, one bit by one bit.

8. A display device comprising:

a display panel including M ($2 \leqq M \leqq m \times k$, m is an integer greater than one and k is an integer greater than zero) data electrodes and N ($2 \leqq N$) scan electrodes arranged within a screen;

a driving device controlling potentials of the data electrodes and the scan electrodes for selective addressing, the driving device including an address driver circuit having k integrated circuit devices and i ($1 \leqq i \leqq k$) power recycling circuits; and the power recycling circuit including first and second inductance elements for resonance with the capacitance within the screen, wherein the integrated circuit device includes m output terminals, each of which corresponds to each of the m data electrodes, two connecting terminals connecting to an external power recycling circuit, 2×m switches controlling continuity between each of the m output terminals and each of the two connecting terminals and a switch driver circuit controlling the 2×m switches and comprising a register memorizing 2×m bits of control data and outputting two bits of the control data corresponding to each one of the m output terminals to two respective switches corresponding to the one output terminal, one bit by one bit.

* * * * *